US009702211B2

(12) United States Patent
Tinnen

(10) Patent No.: US 9,702,211 B2
(45) Date of Patent: Jul. 11, 2017

(54) METHOD AND AN APPARATUS FOR RETRIEVING A TUBING FROM A WELL

(71) Applicant: AKER WELL SERVICE AS, Stavanger (NO)

(72) Inventor: Bard Martin Tinnen, Stavanger (NO)

(73) Assignee: Altus Intervention AS, Stavanger (NO)

( * ) Notice: Subject to any disclaimer, the term of this patent is extended or adjusted under 35 U.S.C. 154(b) by 359 days.

(21) Appl. No.: 14/375,278

(22) PCT Filed: Jan. 29, 2013

(86) PCT No.: PCT/NO2013/050019
§ 371 (c)(1),
(2) Date: Jul. 29, 2014

(87) PCT Pub. No.: WO2013/115655
PCT Pub. Date: Aug. 8, 2013

(65) Prior Publication Data

US 2014/0352976 A1 Dec. 4, 2014

(30) Foreign Application Priority Data

Jan. 30, 2012 (NO) ..... 20120094

(51) Int. Cl.
*E21B 23/00* (2006.01)
*E21B 31/20* (2006.01)
(Continued)

(52) U.S. Cl.
CPC ..... *E21B 31/20* (2013.01); *E21B 21/00* (2013.01); *E21B 23/00* (2013.01); *E21B 29/00* (2013.01); *E21B 31/00* (2013.01)

(58) Field of Classification Search
CPC ..... E21B 31/00; E21B 21/00; E21B 23/00; E21B 29/00; E21B 31/20; E21B 31/16
See application file for complete search history.

(56) References Cited

U.S. PATENT DOCUMENTS 1,795,322 A * 3/1931 Triplett ..... E21B 31/18 294/86.15
2,781,854 A * 2/1957 Boer ..... E21B 23/06 166/179

(Continued)

FOREIGN PATENT DOCUMENTS

EP 1184536 A2 3/2002
GB 2226583 A 7/1990

(Continued)

*Primary Examiner* — Daniel P Stephenson
(74) *Attorney, Agent, or Firm* — Gable Gotwals

(57) ABSTRACT

This invention relates to a method and apparatus for retrieving a tubing from a well at least partly filled with a liquid. The tubing has first and second end portions. Method steps include: (a) running a retrieval apparatus using connecting means from a surface into the well, retrieval apparatus including: means for engaging tubing; means for sealing a portion of the bore of tubing; means for injecting a low density fluid into tubing, (b) connecting engagement means to a portion of tubing; (c) activating sealing means to close liquid communication in the bore of tubing between first and second end portions; (d) replacing at least a portion of a volume of liquid defined by sealing means, tubing and second end portion (B-B') of the tubing by a low density fluid introduced in volume by injection means; and (e) retrieving tubing out of the well using connecting means.

13 Claims, 28 Drawing Sheets

(51) Int. Cl.

| | |
|---|---|
| ***E21B 31/00*** | (2006.01) |
| ***E21B 29/00*** | (2006.01) |
| ***E21B 21/00*** | (2006.01) |

(56) References Cited

U.S. PATENT DOCUMENTS 2,808,887 A 10/1957 Erwin
2,942,666 A * 6/1960 Boer ..... E21B 33/127 166/120
2,966,946 A * 1/1961 Kanady ..... E21B 23/04 166/135
3,104,707 A 9/1963 Overly
3,268,003 A * 8/1966 Essary ..... E21B 29/00 166/284
3,447,605 A * 6/1969 Uliczky ..... E21B 33/1275 166/187
3,762,470 A 10/1973 Eggleston
4,949,791 A * 8/1990 Hopmann ..... E21B 17/06 166/378
4,967,841 A * 11/1990 Murray ..... B08B 9/0433 134/22.12
5,117,915 A * 6/1992 Mueller ..... E21B 7/04 166/381
5,181,571 A * 1/1993 Mueller ..... E21B 7/04 166/381
5,718,292 A * 2/1998 Heathman ..... E21B 33/1277 166/187
7,083,209 B2 * 8/2006 Leman ..... E21B 31/18 294/86.17
8,002,032 B2 * 8/2011 Cenac ..... E21B 31/18 166/250.08
8,590,613 B2 * 11/2013 Bowersock ..... E21B 31/18 166/301
2004/0221997 A1 * 11/2004 Giroux ..... E21B 4/02 166/380
2009/0288840 A1 11/2009 Eriksen et al.
2014/0352976 A1 * 12/2014 Tinnen ..... E21B 31/00 166/377
2015/0226036 A1 * 8/2015 Wolf ..... E21B 23/00 166/311

FOREIGN PATENT DOCUMENTS

WO WO2007014465 A1 2/2007
WO 2007140612 A1 12/2007
WO 2009005479 A1 1/2009
WO 2011061506 A2 5/2011

* cited by examiner

METHOD AND AN APPARATUS FOR RETRIEVING A TUBING FROM A WELL

CROSS-REFERENCE TO RELATED APPLICATIONS

This United States National Phase of PCT Application No. PCT/NO2013/050019 filed 29 Jan. 2013 claims priority to Norwegian Patent Application No. 20120094 filed 30 Jan. 2012, each of which are incorporated herein by reference.

BACKGROUND OF THE INVENTION

This invention relates to a method and an apparatus for retrieving a tubing from a well. More specifically, the invention relates to the removal of tubular from wells associated with the production of hydrocarbons.

When wells are permanently plugged and abandoned, well tubular such as the production tubing and casing may have to be pulled out of the well. In areas such as the North Sea, wells may be deep and completed with relatively large dimension pipe. Consequently, the cumulative weight of tubing and/or casing may become very high, requiring heavy duty lifting/pulling equipment to retrieve it from the well.

In some cases, wells to be permanently plugged and abandoned are located onboard old platforms where the original drilling equipment in place has been removed. Traditionally, for such cases, drilling rigs such as jack-up rigs has to be mobilized to pull the relevant tubular out of the well, entailing a substantial cost. Similar considerations apply for subsea wells, where floating drilling rigs have to be mobilized for plug and abandonment operations to retrieve tubing and casing from the wells.

On platforms, as an alternative to mobilizing rigs, tubular jack systems have been developed for this purpose. Despite being a significant improvement compared to rig mobilization what costs regard, tubing jacking systems may still encompass relatively bulky and expensive equipment modules.

Besides the equipment required for the pulling of tubing/casing, associated steps of an abandonment process may comprise various wireline operations, fluid pumping operations as well as the placement of cement plugs using coil tubing. Altogether, the combination of all these services might yield a bulky and expensive equipment package.

A common feature with most known systems and methods related to tubing and casing retrieval is that they are designed and dimensioned for pulling very high weight, and that an operation is normally conducted by cutting the tubular deep in the well, and then retrieving it to the surface in one go.

For subsea wells, subsea located tubular jack systems have been conceptualized. No commercial system has been made as of yet, but may be under development.

Besides systems developed to pull the tubing from surface, there exists one known system for jacking tubular in the underground. The system features double anchor modules and a hydraulic actuator, operated on drill pipe, snubbing pipe or coil tubing, and is typically used to release piping that is stuck in the well. Here, rather than pulling (and/or jarring) from surface, the jack is engaged to the pipe that is stuck by means of a first anchoring module, whereupon a second anchoring module is engaged to a different mechanical reference point, typically the casing, whereupon the actuator is operated to jack the stuck pipe segment loose. The use of downhole jacks is very practical to release stuck piping, but considered to be impractical for traditional tubing/casing retrieval as the operation would be very time consuming.

The object of the invention is to provide for a system and method for retrieving tubular from a well that is more time and cost efficient than current systems and methods. Moreover, it is an objective of the invention to provide for a system that requires less pulling (and/or pushing) force than what is the situation with the current art methods, so that heavy duty pipe retrieval equipment can be replaced by lighter equipment. Thus, the present invention provides for the retrieval of well tubular by means of lighter well servicing techniques such as wireline and/or coil tubing.

The object is achieved in accordance with the invention, by the characteristics stated in the description below and in the following claims.

According to a first aspect of the present invention there is provided a method for retrieving a tubing from a well at least partly filled with a liquid, the tubing having a first end portion and a second end portion, wherein the method comprising the steps of:

- running a retrieval apparatus using a connecting means from a surface and into the well, the retrieval apparatus comprising:
  - an engagement means for engaging the tubing;
  - a sealing means for sealing a portion of the bore of the tubing;
  - injection means for injecting a low density fluid into the tubing,
- connecting the engagement means to a portion of the tubing;
- activating the sealing means to close liquid communication in the bore of the tubing between the first end portion and the second end portion;
- replacing at least a portion of a volume of liquid by a low density fluid introduced in said volume by the injection means; and
- retrieving the tubing out of the well using the connecting means.

The volume of liquid to be replaced may be defined by the sealing means, the tubing and the second end portion of the tubing. Thus, the low density fluid is injected directly into the liquid.

The sealing means may comprise an inflatable bladder arranged to be filled with the low density fluid so that the low density fluid replaces the volume of liquid by increasing the volume of the bladder.

The low density fluid may be supplied from the surface of the well through a line extending from the surface to the apparatus.

In an alternative embodiment, the low density fluid may be supplied from a vessel operable to communicate low density fluid to the injection means, the vessel being arranged between the apparatus and the surface of the well.

In still another alternative embodiment, the low density fluid is supplied from both the surface of the well and from the vessel.

The buoyancy of the tubing may be controlled during retrieval by replacing a volume of the low density fluid in the tubing by a liquid.

In one embodiment a packer is introduced in the bore of the tubing between the sealing means and the second end portion of the tubing. Thus, a chamber defined by the sealing means, the packer and the wall of the tubes is provided. In a preferred embodiment the chamber is provided with a valve arrangement such as a check valve that allows for one-way flow of fluid out of the chamber.

According to a second aspect of the present invention there is provided an apparatus for retrieving a tubing from a well at least partly filled with a liquid, the tubing having a first end portion and a second end portion, wherein the apparatus comprising:

an engagement means for engaging the tubing;

a sealing means for sealing a portion of the bore of the tubing;

injection means for injecting a low density fluid into the tubing in or at an elevation below, the sealing means; and connecting means to a surface of the well.

The sealing means may comprise an inflatable bladder for receiving low density fluid injected by the injections means. In such an embodiment the low density fluid is injected into the tubing via the inflatable bladder, so that the low density fluid replaces the volume of liquid by increasing the volume of the bladder.

Alternatively, the low density fluid is injected directly into the liquid in the tubing at an elevation below the sealing means.

The apparatus may further comprise a control module comprising one or a combination of; means for controlling the engagement means; means for controlling the sealing means; one or more sensor means selected from of the group comprising: pressure sensor, temperature sensor, acceleration sensor, velocity sensor.

The control module may further be provided with at least one valve for communicating a fluid into or out of the tubing.

The control module may further comprise means for disconnecting the connecting means from the apparatus.

In one embodiment the apparatus is further provided with a pumping device arranged for evacuating a liquid contained between the sealing means and a packer arranged in the bore of the tubing between the sealing means and the second end portion of the tubing.

A third aspect of the present invention regards use of a low density fluid for increasing buoyancy of a tubing in a well at least partly filled with a liquid, and thereby facilitating retrieval of the tubing from the well.

Although a low density fluid in the form of a gas is preferred for increasing the buoyancy of the tubing, the low density fluid may also be a liquid having a lower density than the heavy fluid to be replaced. Thus, a condensate or even water may be used, for example. However, in the description below the low density fluid will be referred to as gas, but should not exclude other appropriate fluids having a density lower than the heavy fluid to be replaced.

The following describes a non-limiting example of a preferred embodiment illustrated in the accompanying drawings, in which.

Figure 14:
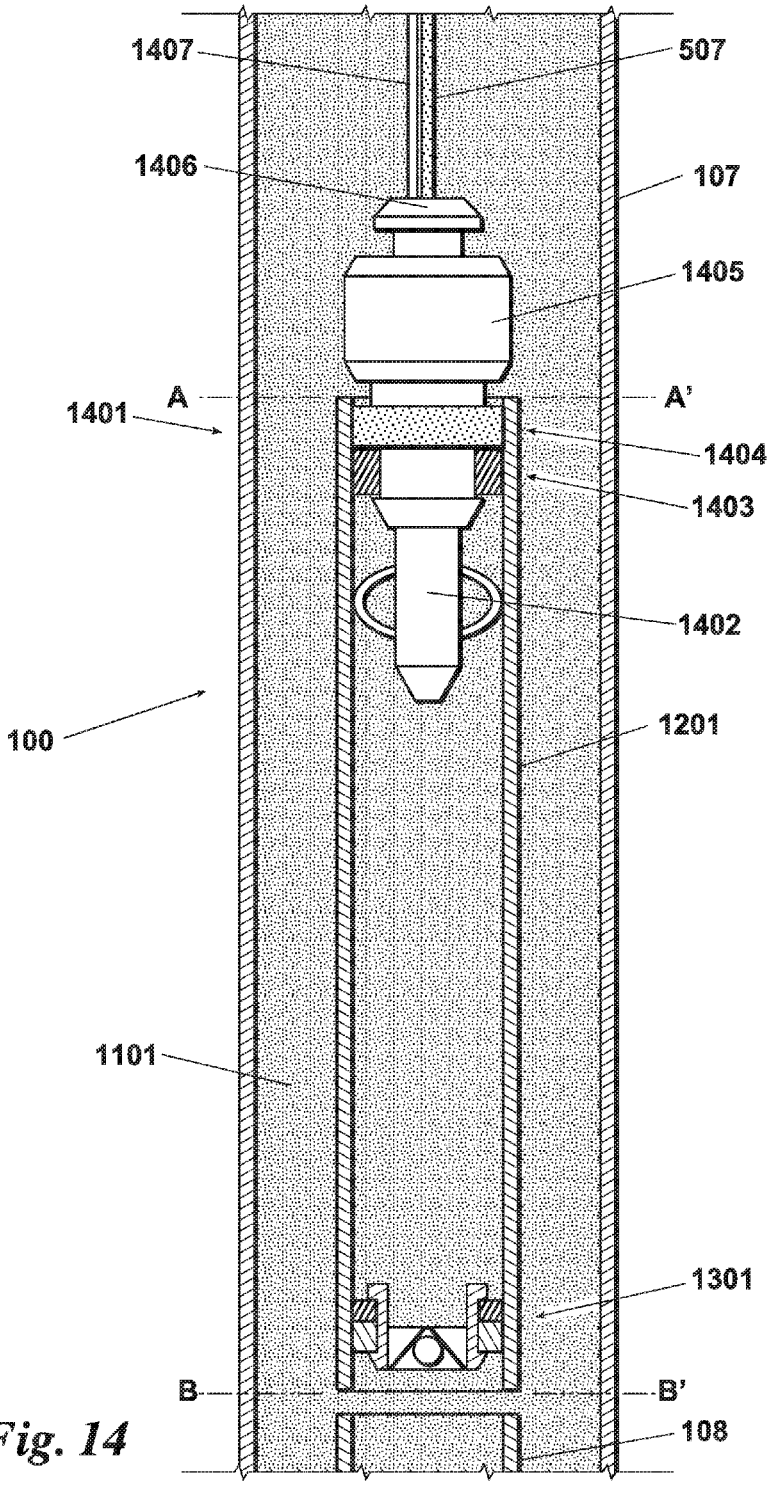
FIG. 14 illustrates a tubing retrieval apparatus according to the present invention connected to a top portion of the tubing in FIGS. 11-13.
Figure 15:
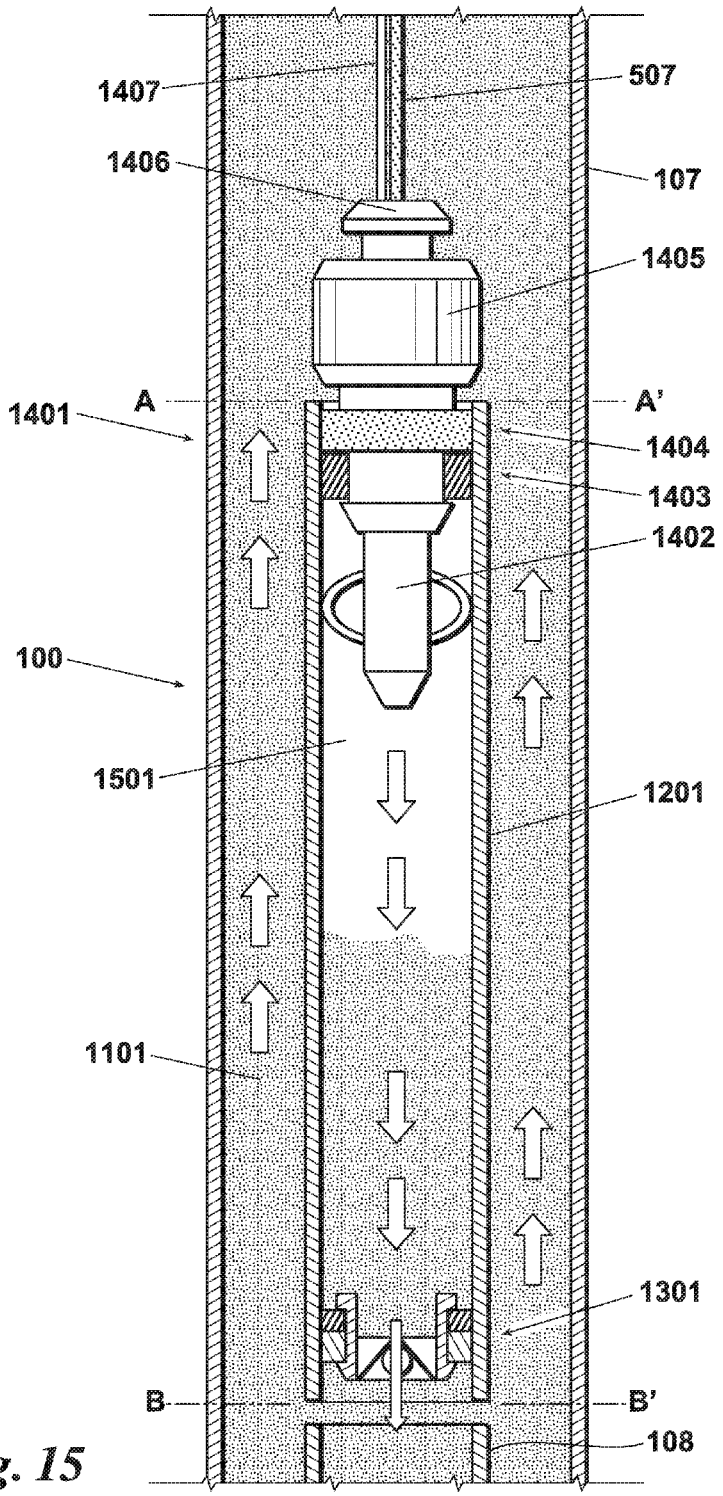
FIG. 15 illustrates the same as FIG. 14, but after the apparatus has started filling the tubular with a low density fluid in the form of a gas.
Figure 24:
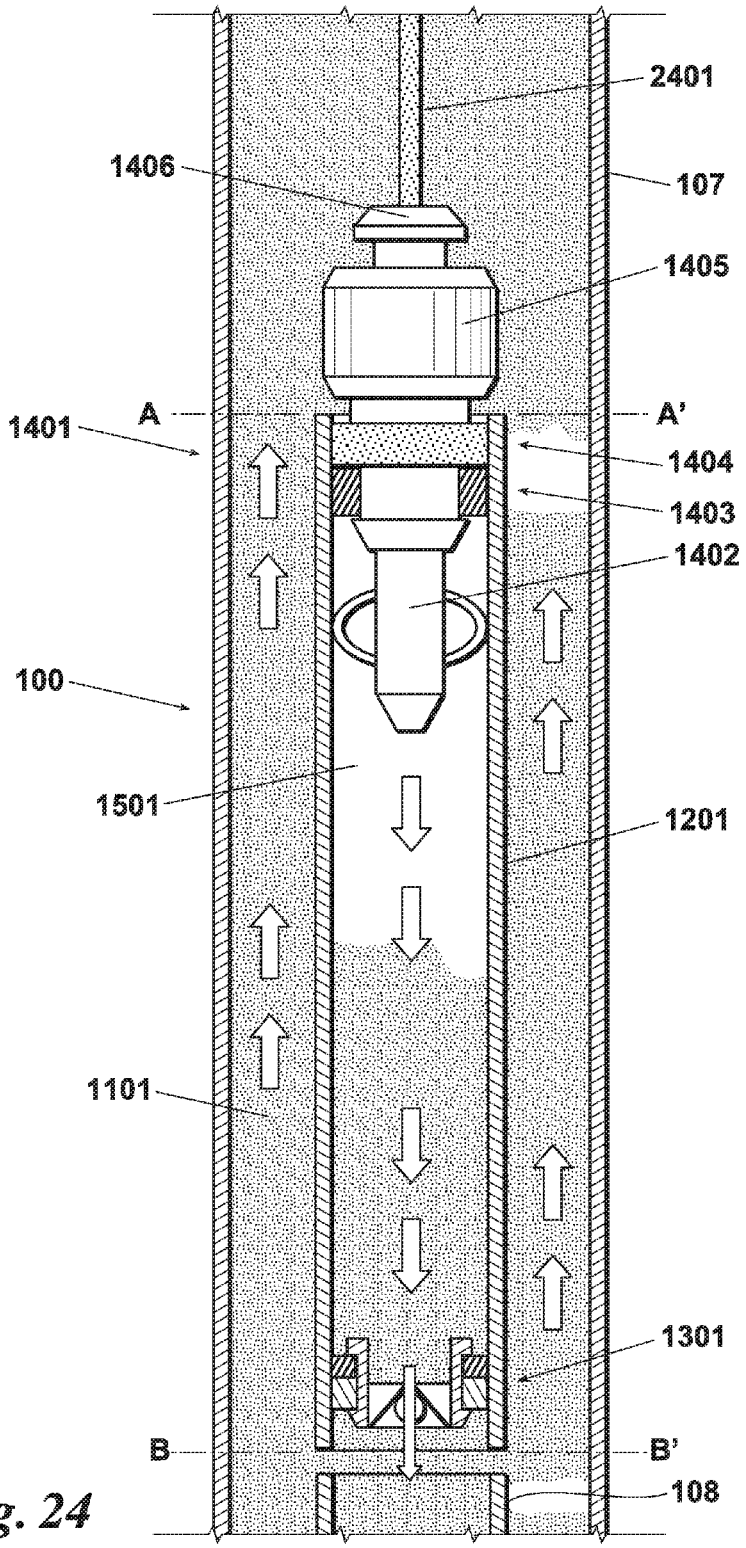
FIG. 24 illustrates the same as FIG. 15 in an alternative embodiment where the apparatus is connected to a wireline comprising a hydraulic line.
Figure 25A:
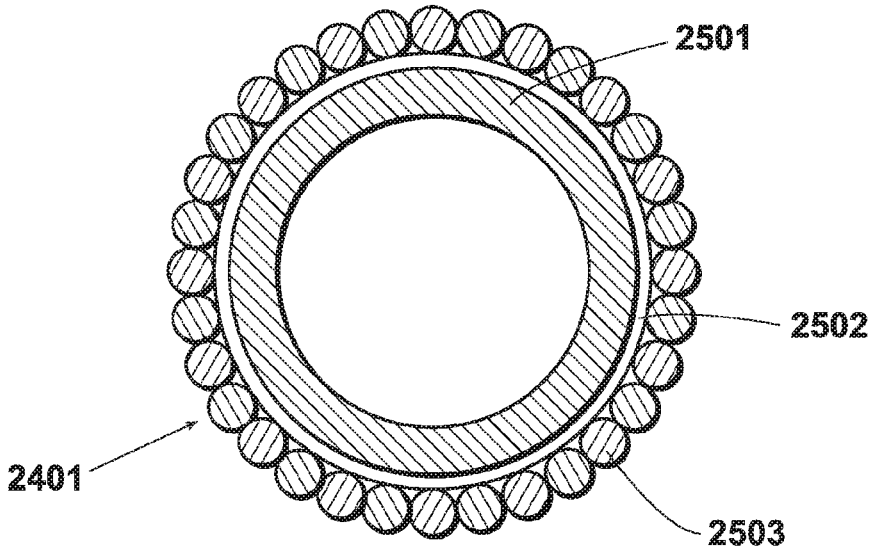
Figure 25B:
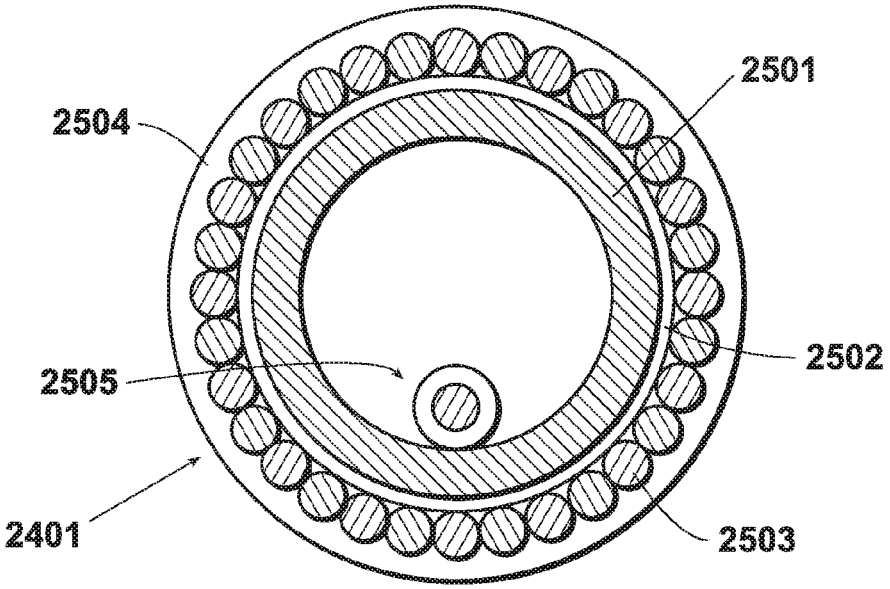
Figure 26:
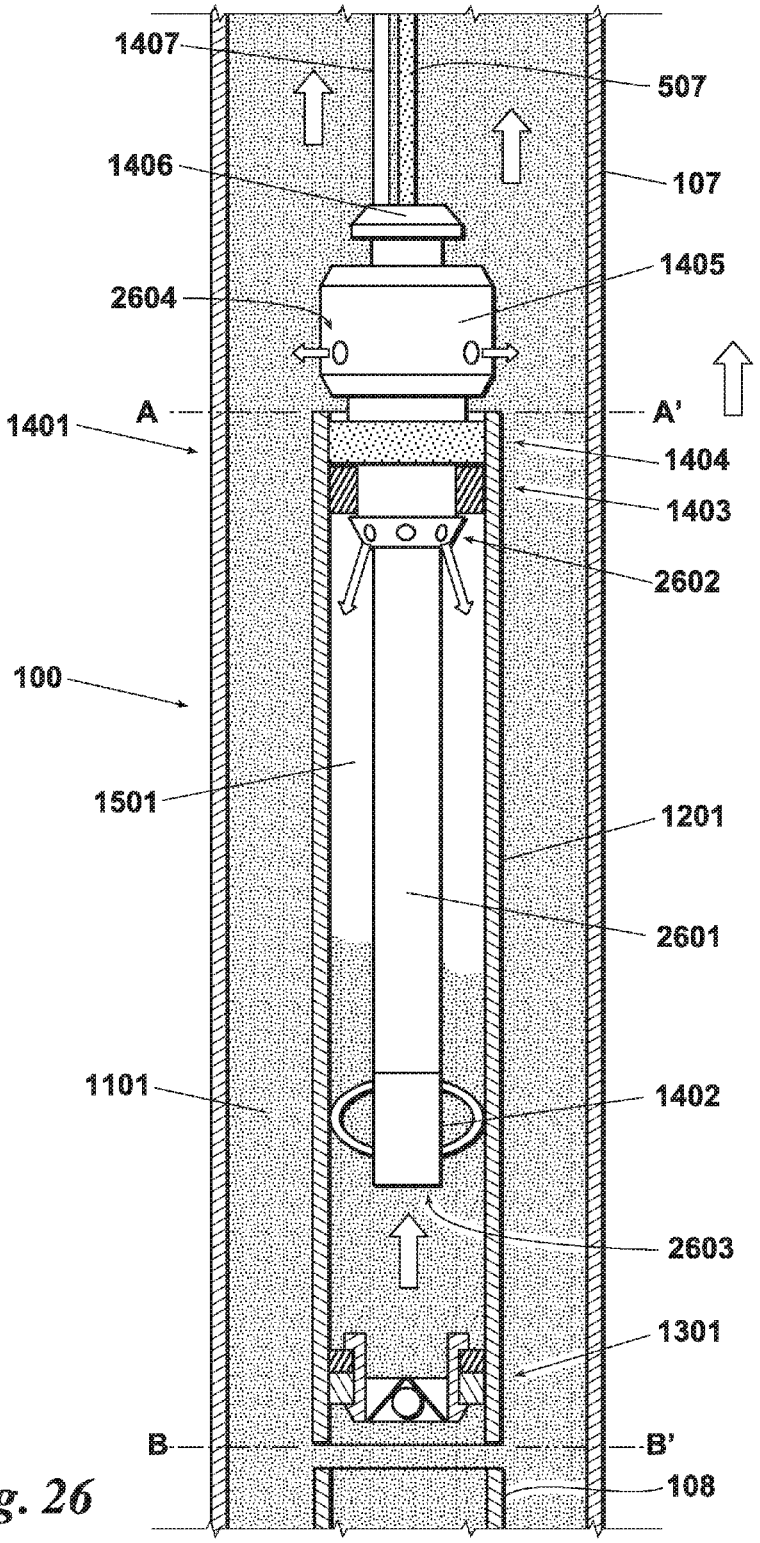
Figure 27:
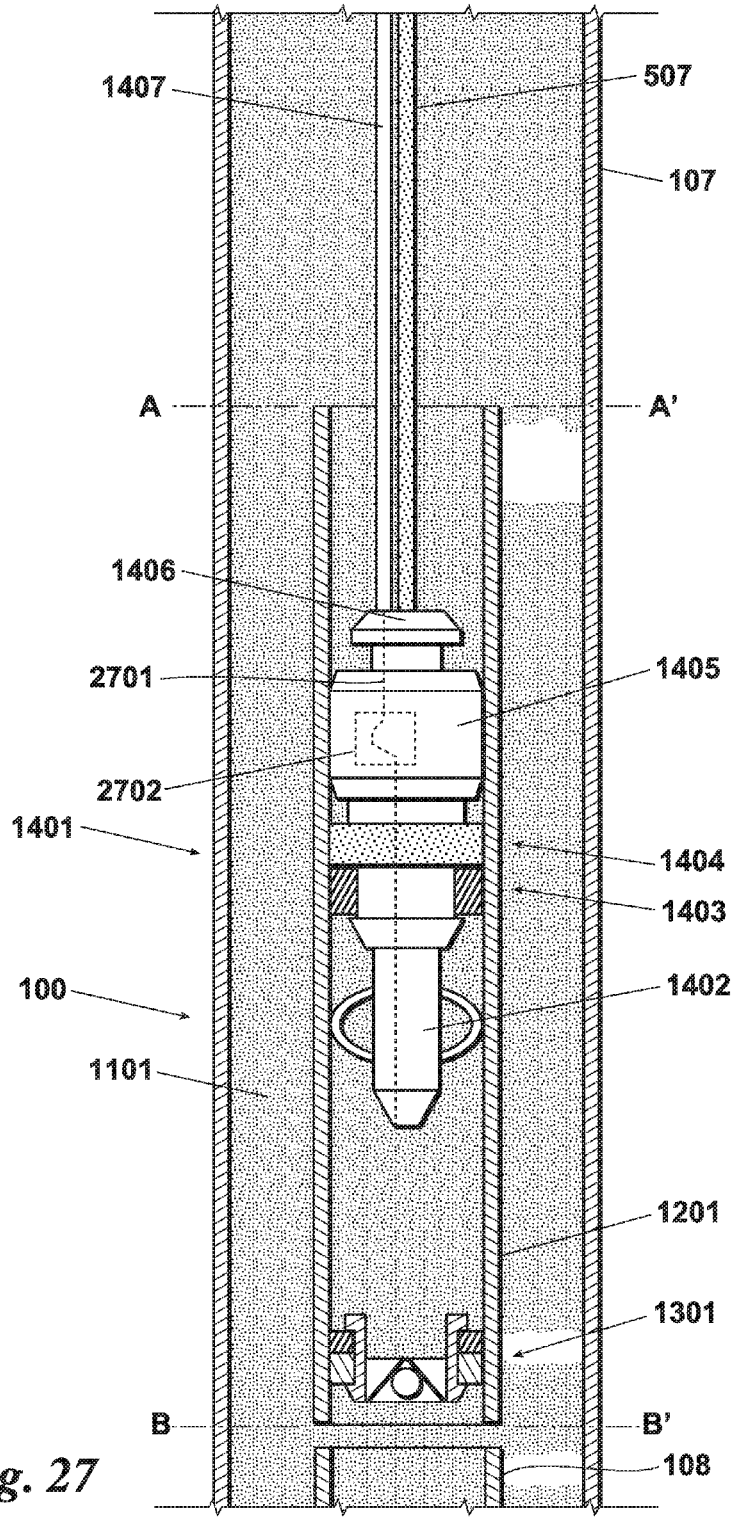
Figure 28:
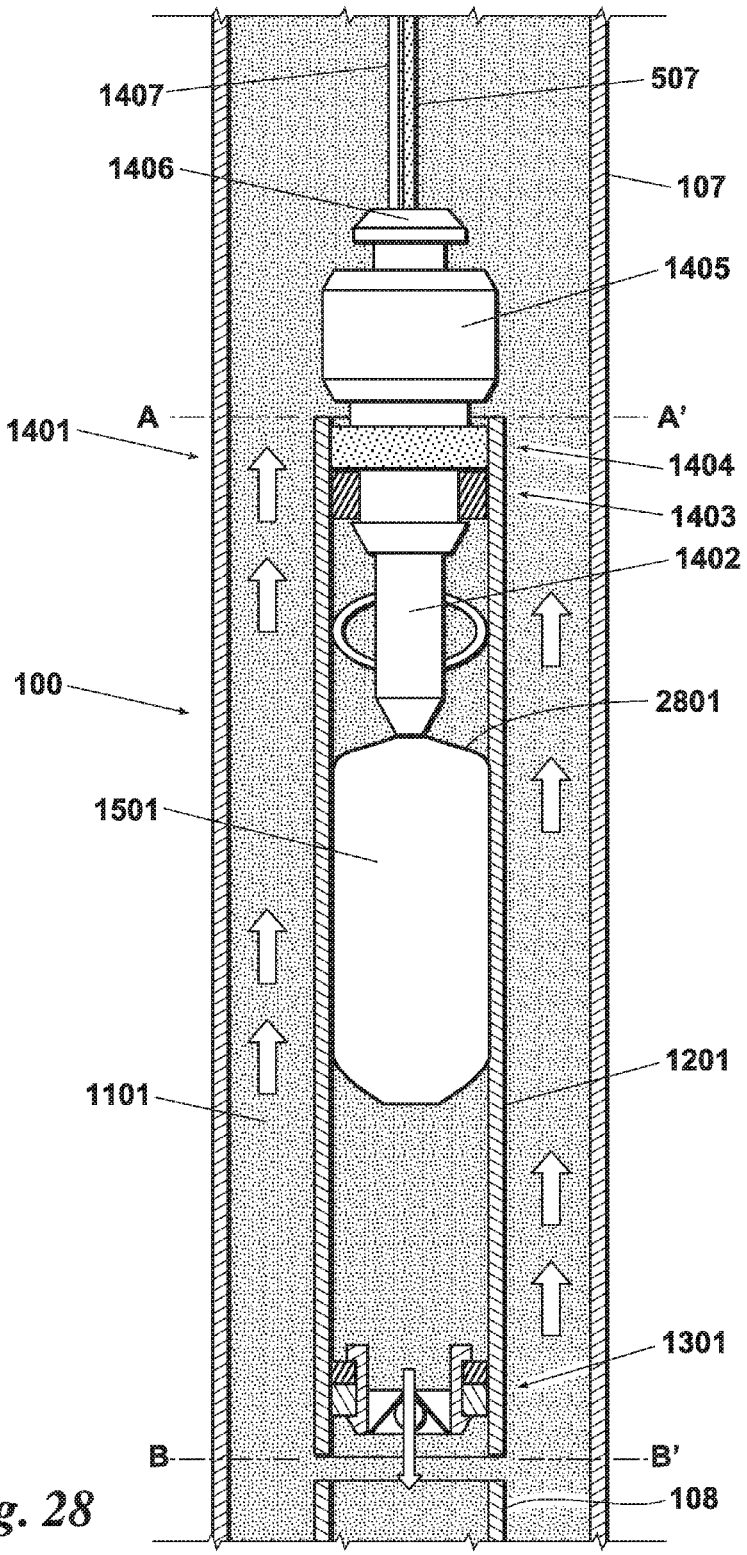

FIG. 25*a* illustrates a cross section of one embodiment of the wireline in FIG. 24;

FIG. 25*b* illustrates a cross section of one embodiment of the wireline in FIG. 24;

FIG. 26 illustrates an alternative embodiment of the apparatus shown in FIG. 15;

FIG. 27 illustrates an embodiment where the apparatus is engaged to the tubing about halfway between the first end portion and the second end portion and not at the first end portion as illustrated e.g. in FIG. 14; and FIG. 28 illustrates an embodiment where the sealing means comprises an inflatable bladder, wherein the bladder replaced the liquid in the tubing as the volume of the bladder is increased by the gas.

In the figures, similar or corresponding parts may be indicated by the same reference numerals.

Position indications such as e.g. upper, lower, above, below, and also directions such as upwards and downwards, refer to the position shown in the figures.

Figure 1:
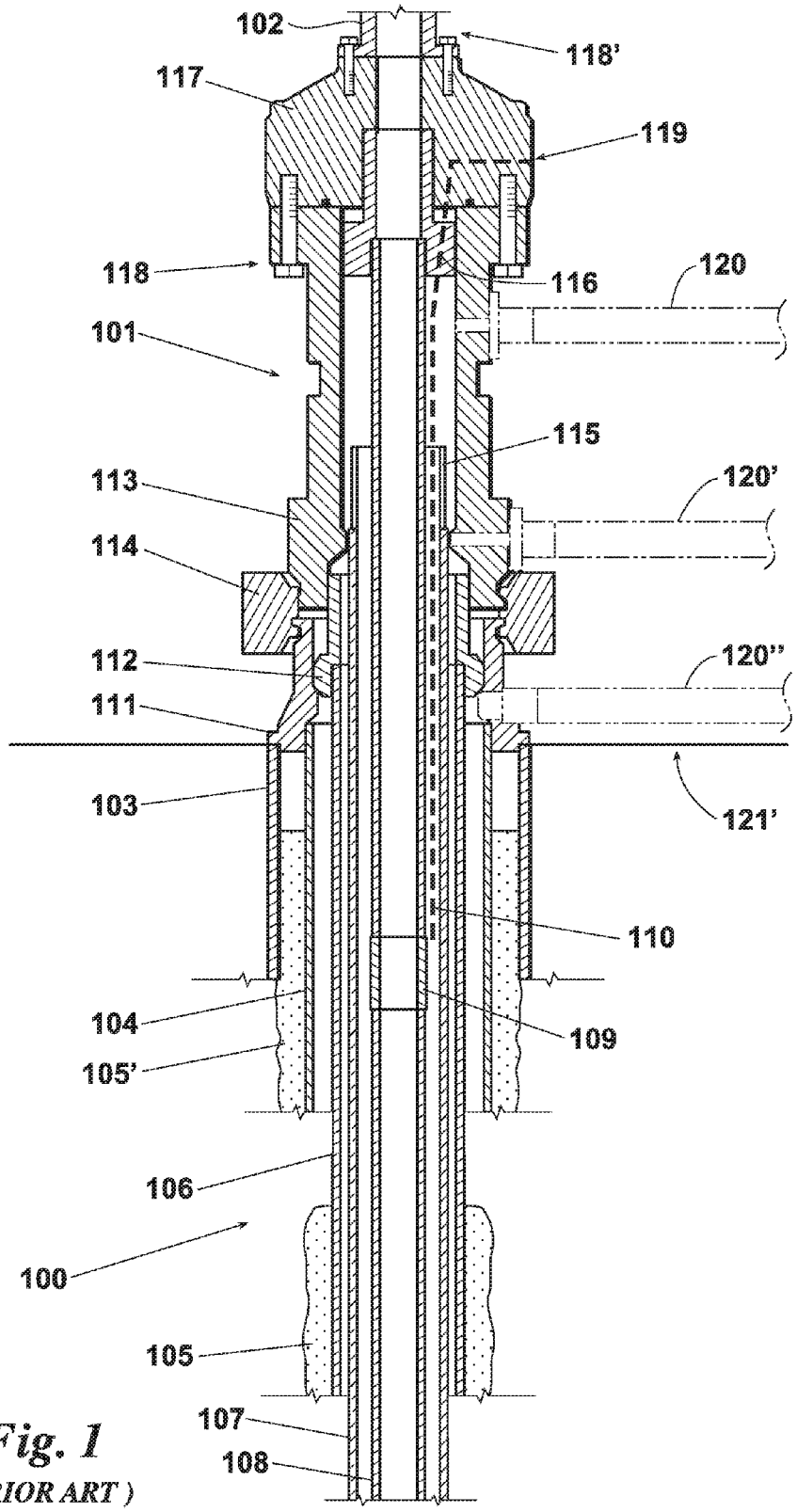
Fig. 1 ( PRIOR ART )
FIG. 1 illustrates a prior art top section of a well and a unihead.

FIG. 1 illustrates a top section of a well 100 and a unihead 101 as will be known by a person skilled in the art. The unihead 101 is the common term for the top section of a well 100 where the different well tubular are fixed to the surface system of the well. A main surface valve block, often referred to as x-mas tree 102, including a bore routing the well production to flow lines and separators, is indicated in the top of FIG. 1.

Various common casing and tubular are shown, starting with a conductor casing 103, a surface casing 104 that is cemented to a formation surrounding the well and to the conductor casing 103 with a cement layer 105, an intermediate casing 106 being cemented to the formation by a cement layer 105', a production casing 107 and a production tubing 108.

Some distance below the unihead 101, the production tubing 108 comprises a downhole safety valve 109. The downhole safety valve is operated by means of a hydraulic control line 110.

The surface casing 104 is suspended from a lower portion 111 of the unihead 101. The intermediate casing 106 is terminated in an intermediate casing hanger 112 that is suspended in the lower portion 111 of the unihead 101. The lower unihead portion 111 is connected to an intermediate unihead portion 113 by means of a clamp 114.

The production casing 107 is terminated in a production casing hanger 115 suspended from the intermediate unihead portion 113. The production tubing 108 is terminated in a tubing hanger 116 suspended from a top end of the intermediate unihead portion 113. A top portion 117 of the unihead 101 forms the connection towards the x-mas tree 102.

Bolts 118/118' are used to hold the upper modules attached as illustrated in FIG. 1. The control line 110 is terminated to and exits the top portion 117 at a termination point 119 from where it runs to a dedicated safety valve control system (not illustrated). Flow lines 120, 120', 120" are connected to the various annuli between the well tubular, to allow for fluid communication such as bleeding off pressure, or pump fluids into the annuli. The wellhead deck level 121' is also indicated.

Figure 2:
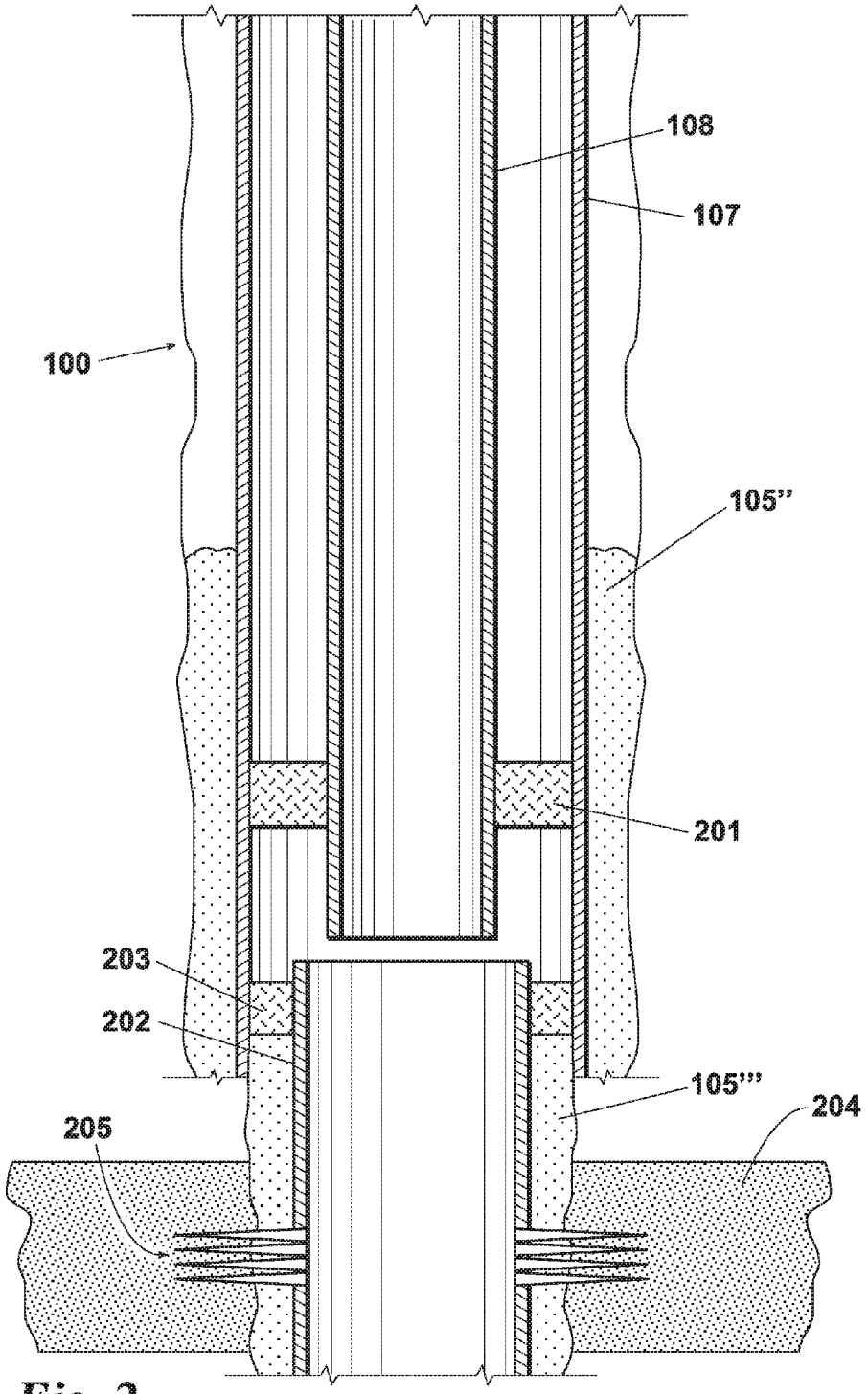
Fig. 2 ( PRIOR ART )
FIG. 2 illustrates in a larger scale a prior art bottom section of a well.

FIG. 2 illustrates a bottom section of a well 100. In the example shown in FIG. 2, the production tubing 108 includes a production packer 201 system that anchors the tubing 108 to and forms a seal against the production casing 107. A production liner 202 is anchored to and forms a seal against the production casing 107 by means of a liner hanger 203. The liner 202 extends through a hydrocarbon bearing formation 204. In FIG. 2 the production casing 107 extends to a location above the top of the hydrocarbon bearing formation 204, whereupon cement 105" is applied to seal off the annular cavity against the surrounding rock formation. In a similar manner, the liner 202 is attached to the surrounding rock formation, including the hydrocarbon bearing layer 204 using cement 105'". Perforations 205 provide for fluid communication between the hydrocarbon bearing formation 204 and the center conduits of the well 100. Although the cement 105", 105'" provides a fixing means for the relevant tubular in the well, the most important function is that the cement 105", 105'" forms a seal in the annular cavity between the surrounding rock formation and the tubular in question.

The exact construction of a well may vary significantly from what is illustrated herein, including a range of additional components and/or control lines as would be appreciated by a person skilled in the art. The same applies for the unihead 101, which may be of a significantly different design and/or contain other and/or more components than what is illustrated herein.

In order to deem a barrier suitable for permanent abandonment purposes, regulations dictate certain requirements that must be adhered to. In general terms, permanent barriers must be of a certain quality; they must fill the entire cross section of the well, including all annuli, and be of a certain minimum length.

Figure 3:
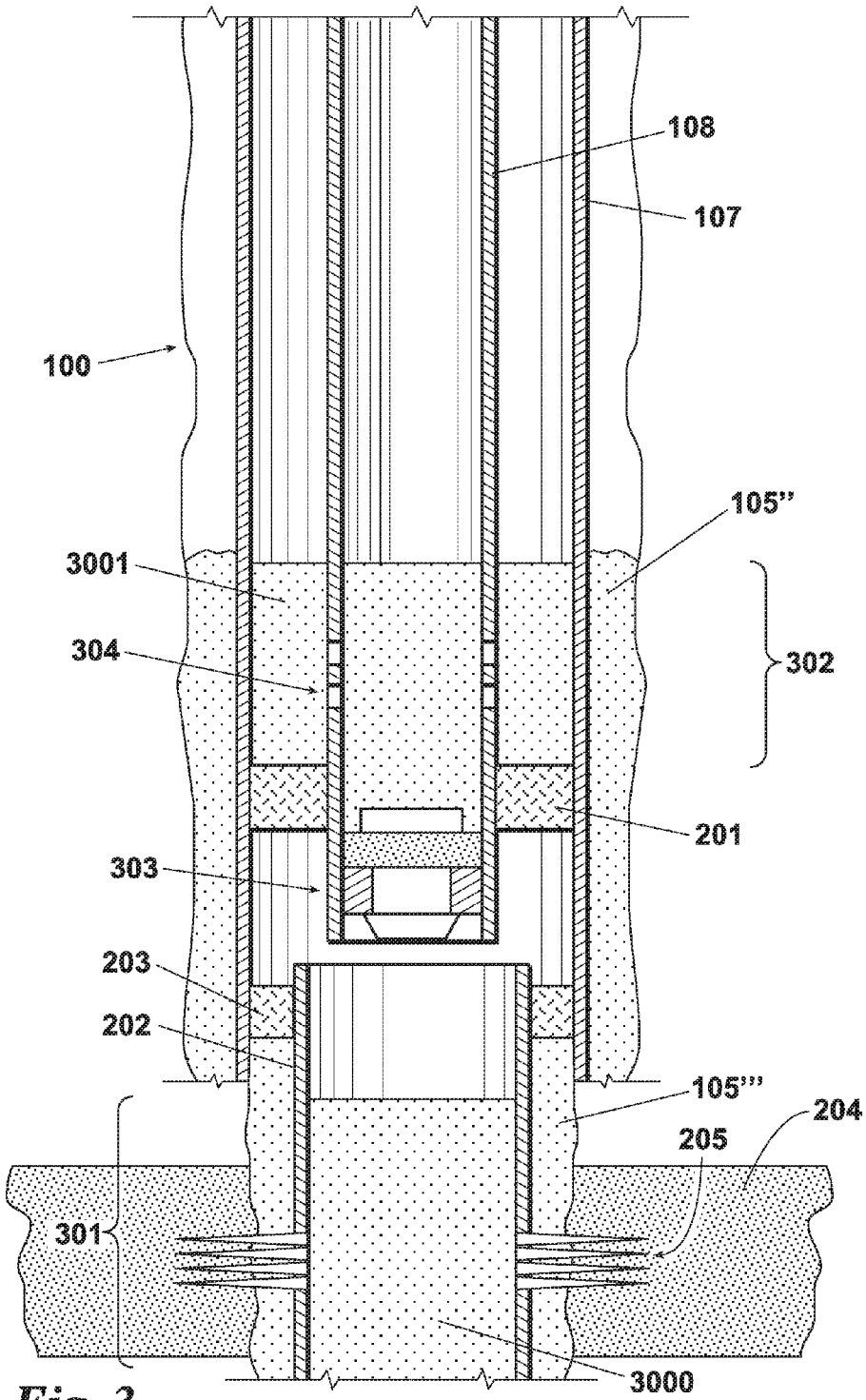
Fig. 3 ( PRIOR ART )
FIG. 3 illustrates prior art permanent barriers installed in a well.

FIG. 3 illustrates examples of permanent barriers installed in a well where a primary barrier 301 is installed in the lower section of the well 100 by means of placing a primary cement plug 3000. For the barrier 301 to be approved as a permanent barrier, the following general requirements apply:

- The primary cement plug 3000 must overlap with the external cement 105'" on the outside of the liner 202 over a length as specified by relevant regulatory clauses.
- The cement 105'" on the outside of the liner 202 must be of a certain minimum length (further to the requirement discussed above), and also of a specific quality.

For permanent abandonment, regulations in most parts of the world state that there should be two barriers between a hydrocarbon bearing formation 204 and the surface. To achieve this, a secondary barrier 302 is installed in the well. In some cases this can be achieved by installing a cement retainer 303 (typically a mechanical plug), and punch holes 304 to provide for fluid communication between the center of the tubing 108 and the annulus between the tubing and the production casing 107, prior to placing the secondary cement plug 3001. Techniques for placement of cement plugs are known to a person skilled in the art and not described any further herein.

The latter method for installing a permanent well barrier could for instance be acceptable if the cement 105" outside the production casing 107 was verified to be of a sufficient length and quality, and that there were no control lines or similar attached to the tubing 108 (no control line is shown in FIG. 3, but regulations prohibit leaving such inside a permanent cement barrier).

In many cases, there is uncertainty whether the cement 105" column on the outside of the production casing 107 is of satisfactory length and quality. In such cases, it may be necessary to run logging tools to investigate on the status of the cement in question. In worst case, the cement 105" column behind the production casing 107 is missing or of insufficient quality to provide a permanent barrier and the old cement has to be removed (or the annulus has to be cleaned) over an interval equal to the required length of the permanent barrier to be installed. There are various techniques for achieving this, ranging from section milling and under-reaming operations to more modern techniques involving perforating the casing 107 and using special types of washing tools to remove the poor cement (or clean the annulus). Such techniques would be known and appreciated by a person skilled in the art and no further referred to herein.

Both for the case where old cement 105" behind casing 107 needs to be logged, as well as for the situations where the cement 105" needs to be removed, the tubing 108 must be removed before such operations can start.

The need for tubing 108 removal during a plug and abandonment job introduces the need for heavy lifting equipment, which complicates the operation and makes it very expensive.

Figure 4:
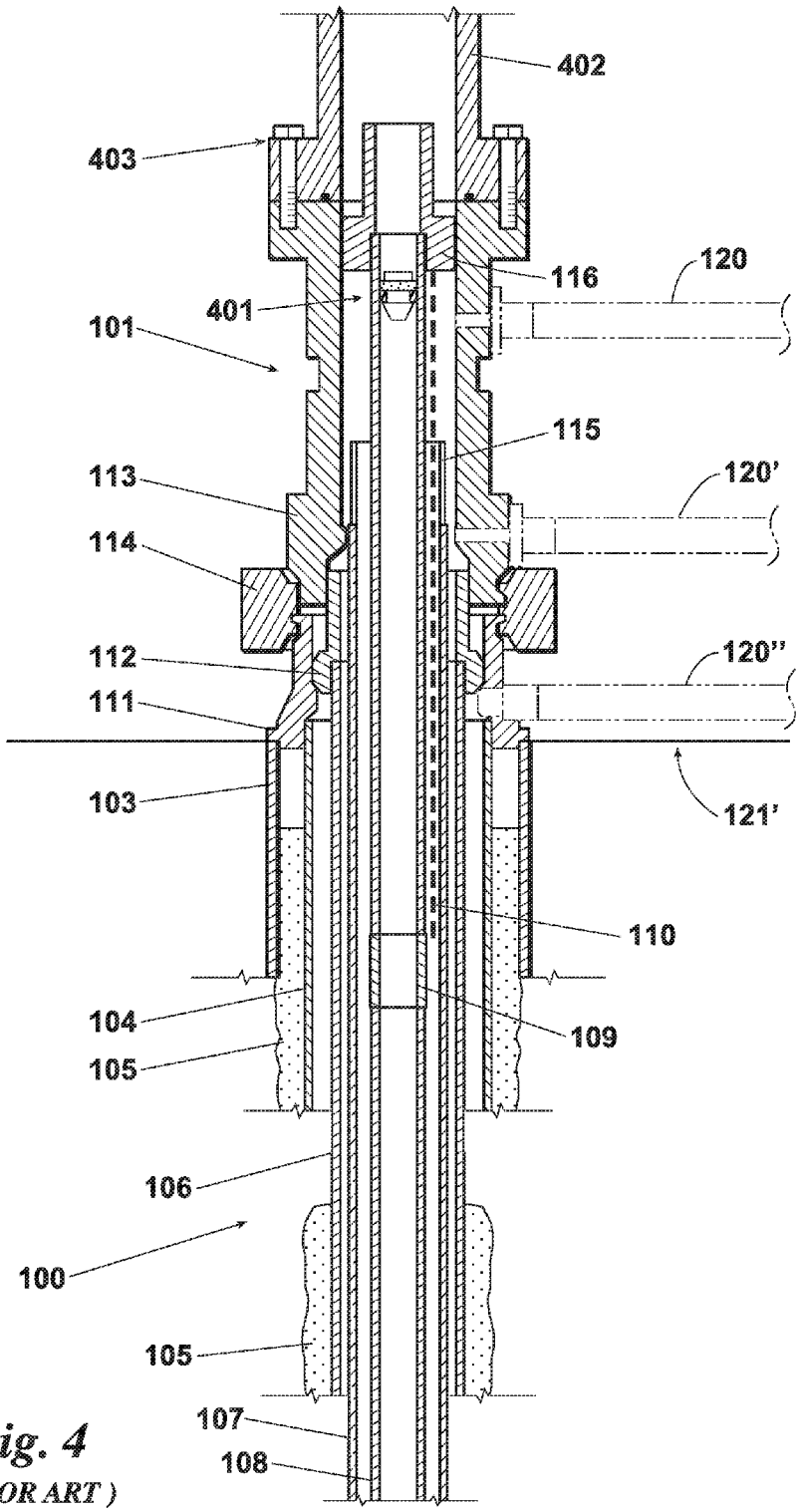
Fig. 4 ( PRIOR ART )
FIG. 4 illustrates in a smaller scale an initial step of preparing for retrieval of a tubing from a well.

FIG. 4 illustrates an initial step in the process of preparing for retrieval of the tubing 108. Prior to the step illustrated in FIG. 4, a variety of preparatory operations may have been performed, such as a wireline drift run, a wireline run to install a deep set mechanical barrier, punching of the tubing 108 and placement of heavy fluid in the tubing 108 as well as the annulus between the tubing and the production casing 107 and more. This would be appreciated by a person skilled in the art and is no further referred to herein.

FIG. 4 illustrates a shallow set barrier 401 such as a back pressure valve (BPV) installed in the top section of the well 100. In most generic cases, there would now be a sufficient number of barriers in place to allow for removing the x-mas tree 102 (shown in FIG. 1) and install a riser 402 and BOP system required to perform the subsequent operational steps. Do note that a there is a distinction between the term "barrier" and "permanent barrier". For instance, a mechanical plug may be a fully accepted barrier for short term operations, but not accepted as a permanent barrier as its steel components may corrode and elastomeric components may deteriorate over time. Bolts 403 are used to attach the riser 402 to the intermediate unihead portion 113.

Typically, the riser 402 and BOP 502 equipment installed at this stage has an inner diameter that is sufficiently large to retrieve the tubing hanger 116 there through. In many cases, the tubing hanger 116 is of a substantially larger outer diameter than the tubing 108 itself.

Figure 5:
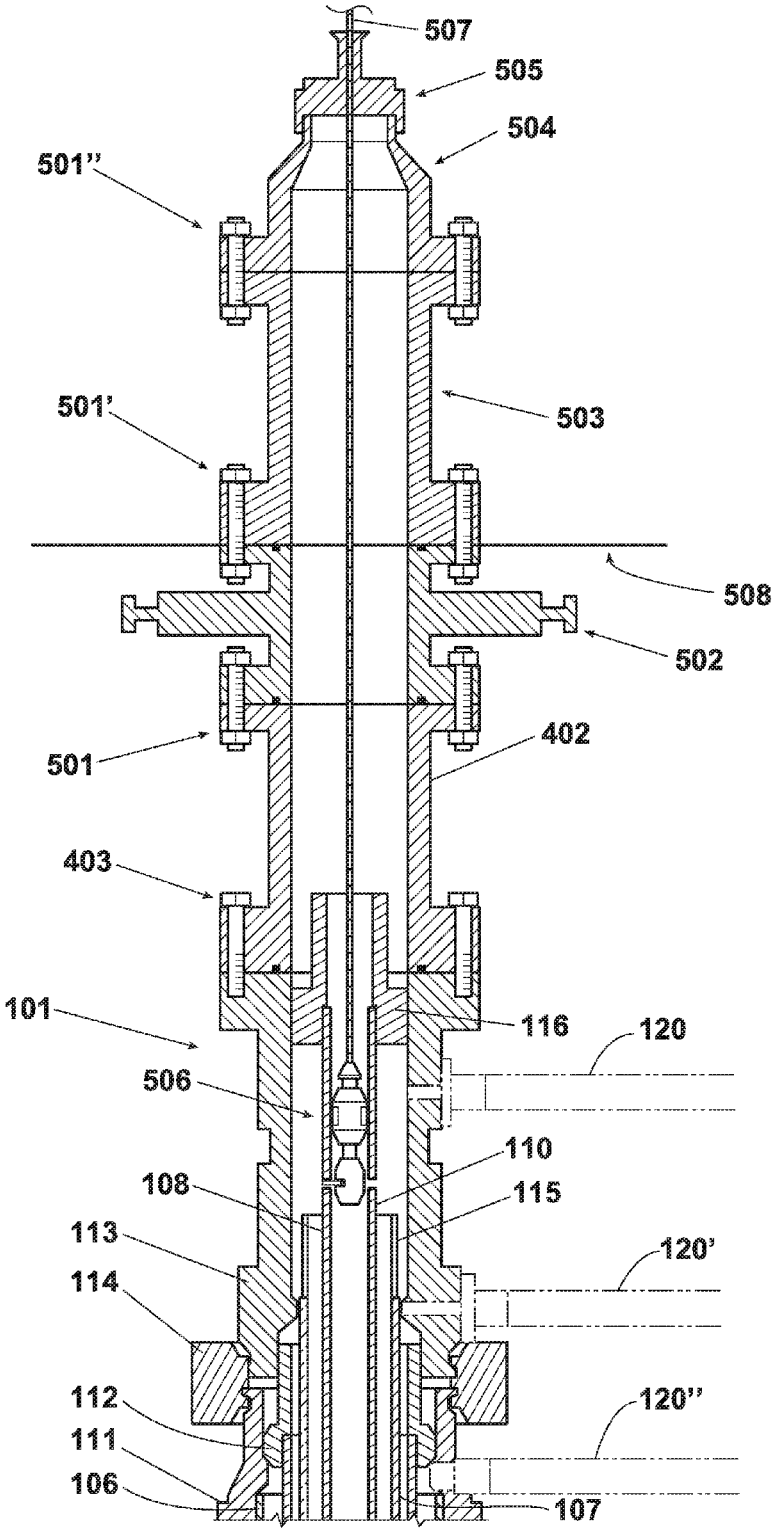
FIG. 5 illustrates in a larger scale a further step of preparing for retrieval of the tubing.

FIG. 5 illustrates the situation after the riser 402 and BOP 502 system has been stacked in place, but where the shallow set barrier 401 shown in FIG. 4 has been removed. For the illustrated embodiment, the upper stack contains various modules that are bolted together using bolt connections 501, 501', 501". On top of the riser 402, a BOP valve 502 is mounted. This BOP valve 502 could be a shear ram. In other embodiments, alternative or additional valve/ram systems could be added, such as pipe rams and blind rams. This would be appreciated by a person skilled in the art. On top of the BOP valve 502 a second riser 503 section, a wireline crossover 504 and a grease injection 505 head are mounted.

The next step in the process of pulling the tubing 108 is to remove the tubing hanger 116 from the well 100. A wireline 507 deployed cutting tool 506 is run in the well to cut the tubing 108 below the tubing hanger 116. Typically, the cut would be placed close to a clamp (not illustrated) used to secure the control line 110 to the tubing 108 to ensure that the control line is cut as well. The well operation deck level, often referred to as the hatch deck 508 is also illustrated.

Figure 6:
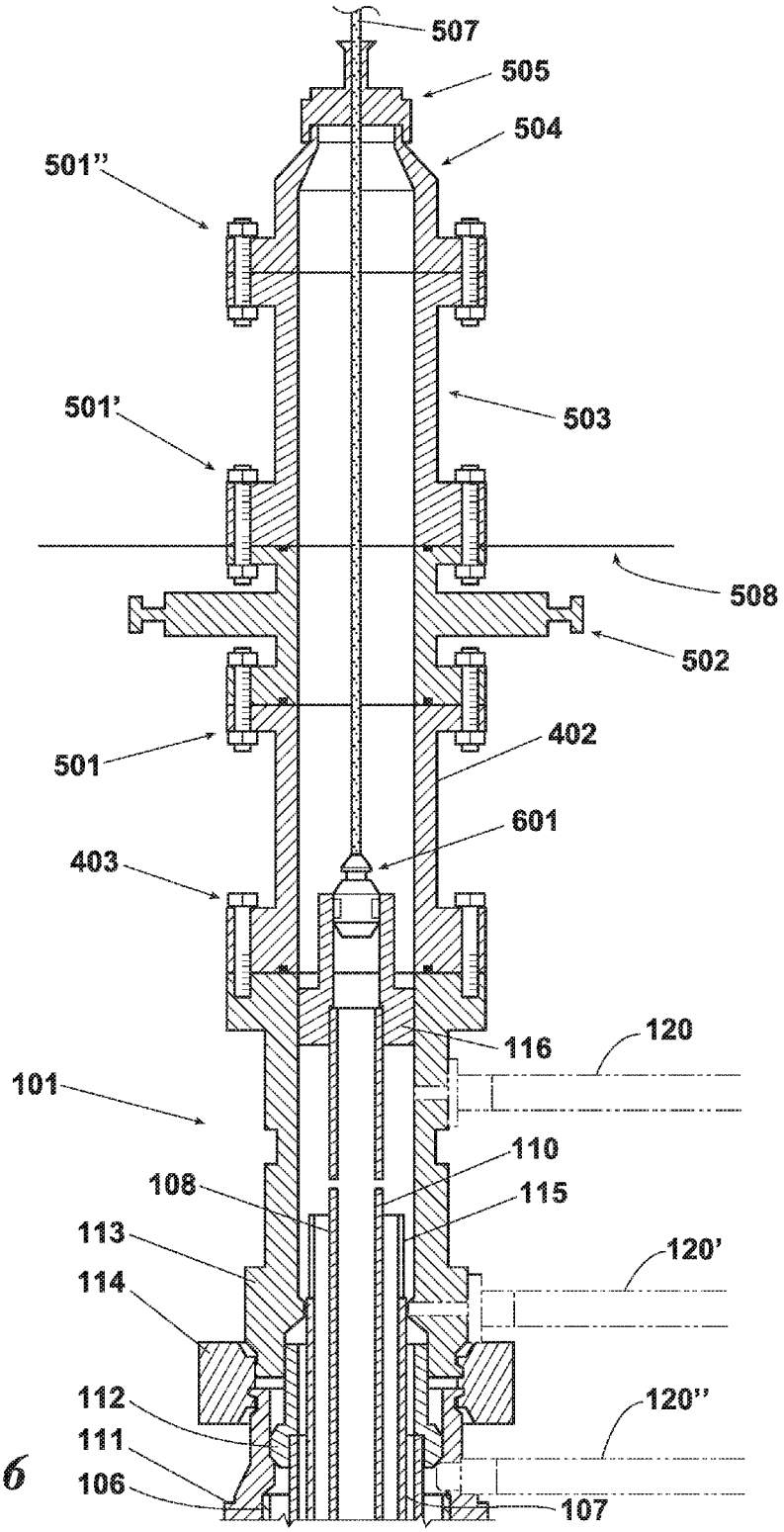
FIG. 6-8 illustrates further prior art steps of preparing for retrieval of the tubing.
Figure 7:
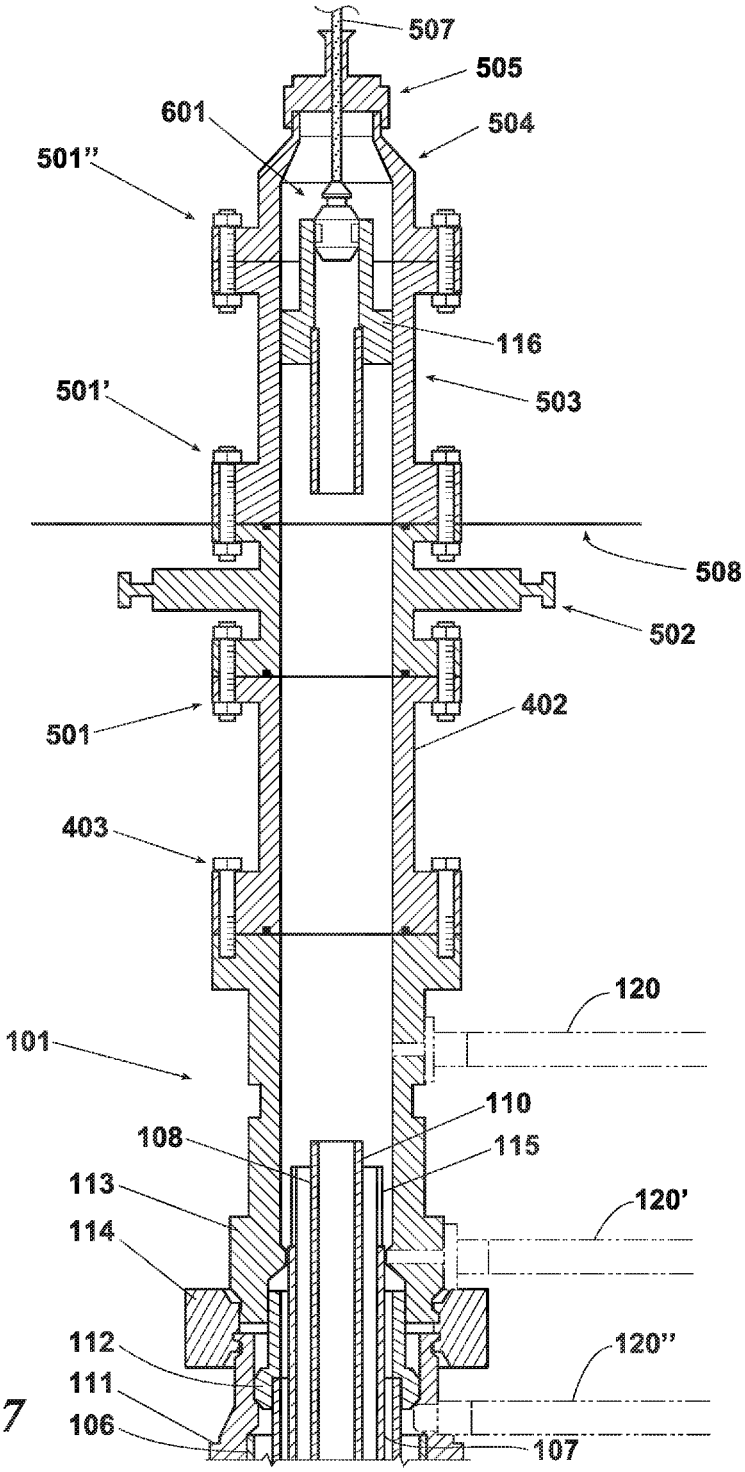

Now considering FIG. 6; after the tubing 108 and control line 110 has been cut, the cutting tool 506 is retrieved, and a pulling tool 601 for the tubing hanger 116 is run in the well 100 and engaged to the tubing hanger 116. Subsequent to this, the tubing hanger 116 is released, typically by unscrewing bolts (not illustrated) that secures the tubing hanger 116 to the intermediate unihead portion 113. Upon doing so, the tubing hanger 116 can be pulled up into the second riser 503, whereupon the BOP valve 502 is closed. This is illustrated in FIG. 7.

Subsequently, the second riser 503 can be disconnected from the BOP valve 502 and the tubular segment containing the tubing hanger 116 can be removed.

In some cases, the tubing hanger 116 may be partly stuck inside the intermediate unihead portion 113, to a degree where traditional wireline cable 507 cannot be used to pull it. Instead, a stronger cable may be used, a solid steel rod or other system for pulling the tubing hanger 116 loose. To provide for sufficient force tailor made jack systems that are suspended from the top of the riser stack could be utilized. Alternatively, other devices capable of creating high push and/or pull forces could be used. This would be appreciated by a person skilled in the art and is no further referred to herein.

Figure 8:
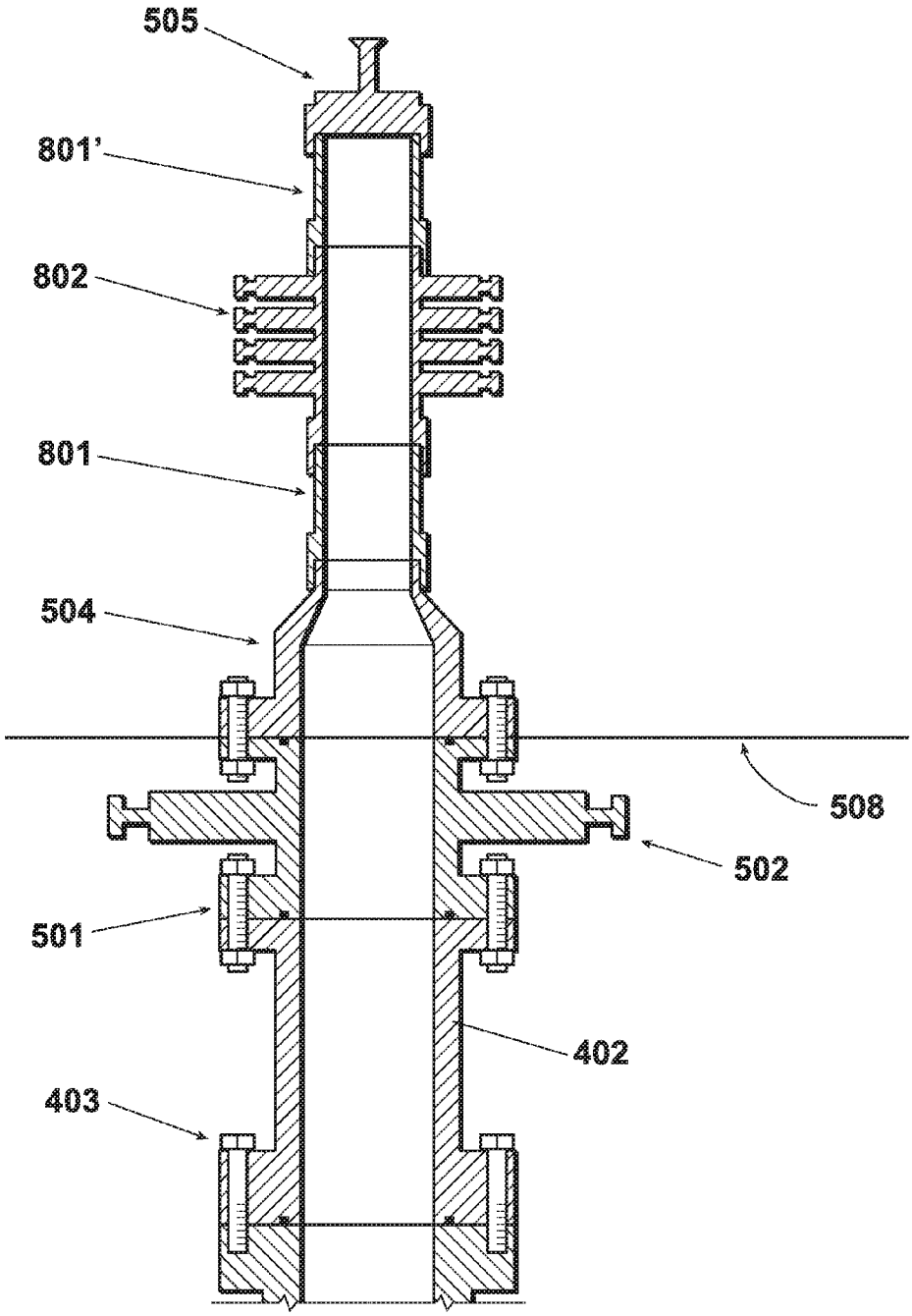

Now considering FIG. 8; after removing the tubing hanger 116, further to a preferred embodiment of the invention, some of the larger bore well control sections such as the second riser 503 would be removed, as this is over-dimensioned for tubing 108 pulling purposes. Instead, a smaller wireline lubricator stack could be applied for the subsequent operations. The wireline lubricator stack would in one embodiment include riser sections 801, 801' and a wireline BOP unit 802. Other system components could also be included, but are omitted from the figure for simplicity. The inclusion of such components would be appreciated by a person skilled in the art.

Figure 9:
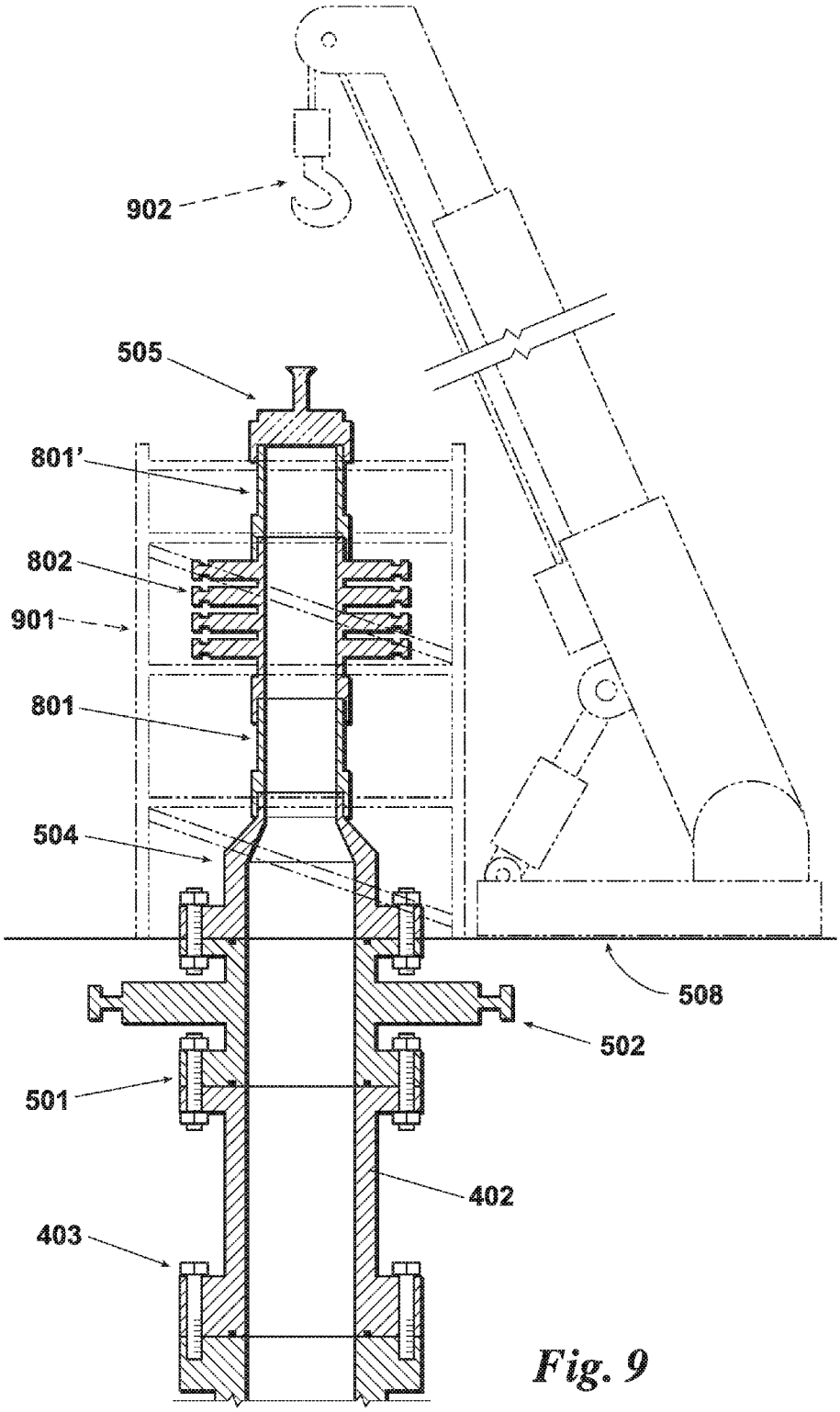
FIG. 9 illustrates a prior art working platform for personnel and a wireline rig-up mast.

As illustrated in FIG. 9, a working platform 901 for personnel and a wireline rig-up mast 902 are typically mounted adjacent to the wireline lubricator prior to commencing the tubing 108 retrieval operation. Normally, the wireline mast 902 will be the main support for a top sheave wheel that the wireline cable 507 is run over when intervening tools in the well. In a preferred embodiment of the invention, the wireline mast 902 will in this context be utilized for the tubing 108 retrieval operation.

Figure 10:
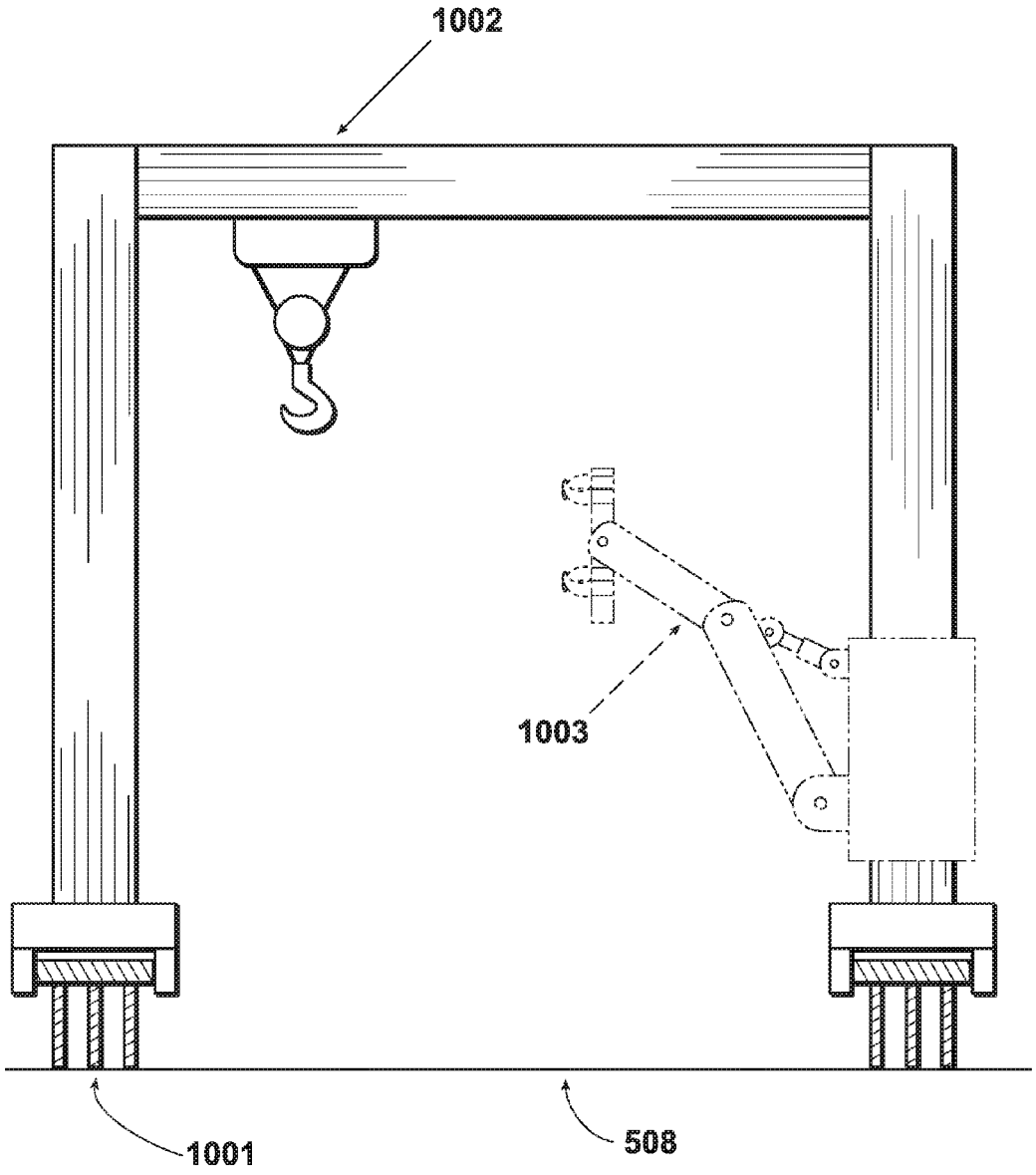
FIG. 10 illustrates a prior art a crane system mounted on skid beams, the system including a pipe handling apparatus.

As a last explanatory step before describing the core method of the invention herein; FIG. 10 describes additional support systems that may be used for lifting and pipe handling operations. On platforms where the drilling rig has been demobilized, skid beams 1001 are normally not removed. In a preferred embodiment of the invention, a modular traverse-crane 1002 or other mobile crane system suited to be mounted and operated on the skid beams 1001 forms part of the mobilized equipment package. Moreover, a tailored pipe handling mast system 1003 could form part of the package. In a preferred embodiment, both crane/mast systems can be lifted onboard the platform and mounted in place using the platform crane. A traverse-crane 1002 is normally the preferred option when rigging up well control equipment such as risers, BOPs etc. as it is more accurate and less impacted by forces such as wind forces than a platform crane, i.e. it makes the operation safer for both personnel and equipment.

Figure 11:
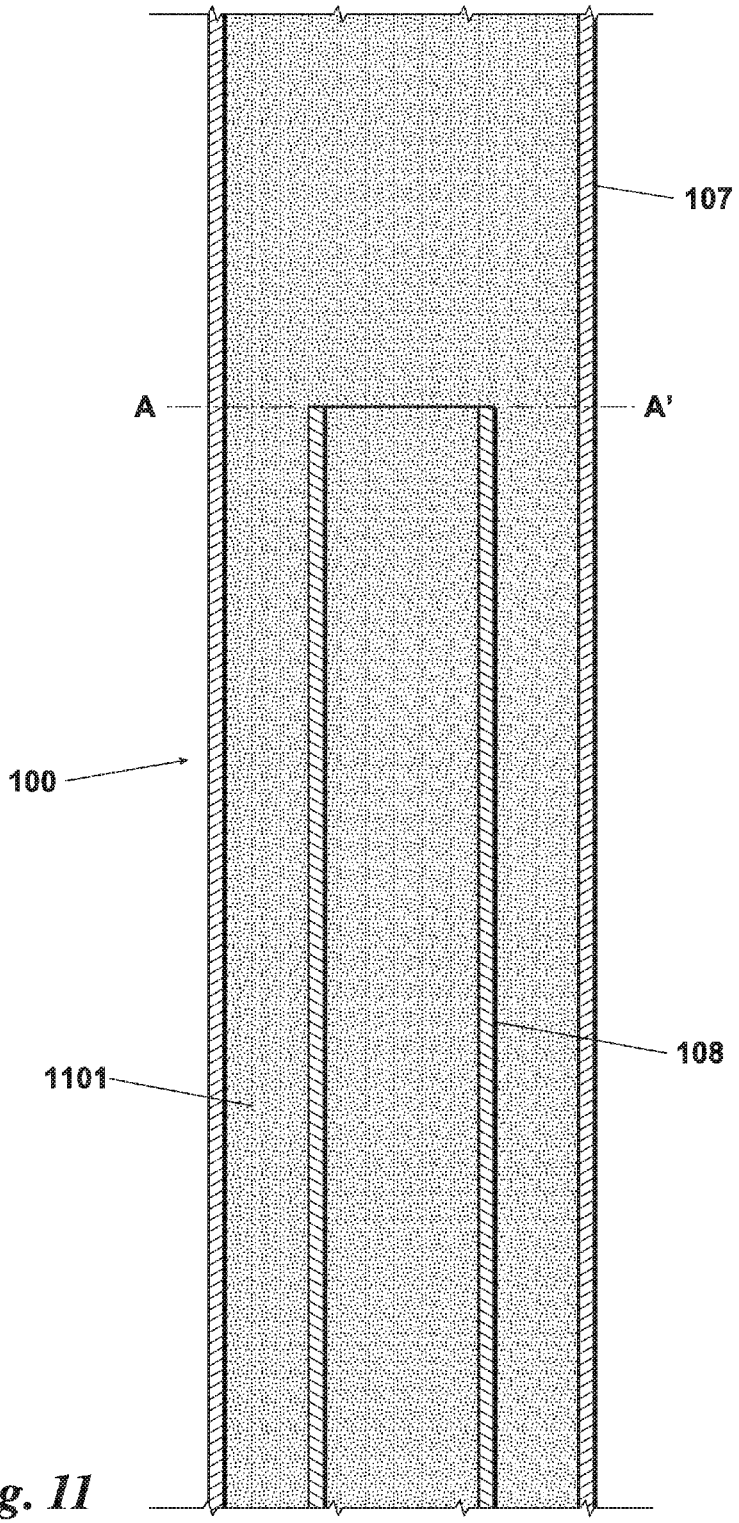
FIG. 11 illustrates in a larger scale a section of a well comprising a tubular within a casing filled with a liquid.

FIG. 11 illustrates a section of the well 100 of consideration. In a previous step, the tubing 108 has been cut, as illustrated by the line A-A', and the section of tubing 108 above the cut has been pulled out of the well 100. In the embodiment shown, the tubing 108 and the annulus between the tubing 108 and the casing 107 are filled with a heavy liquid 1101 such as brine or drilling mud.

Figure 12:
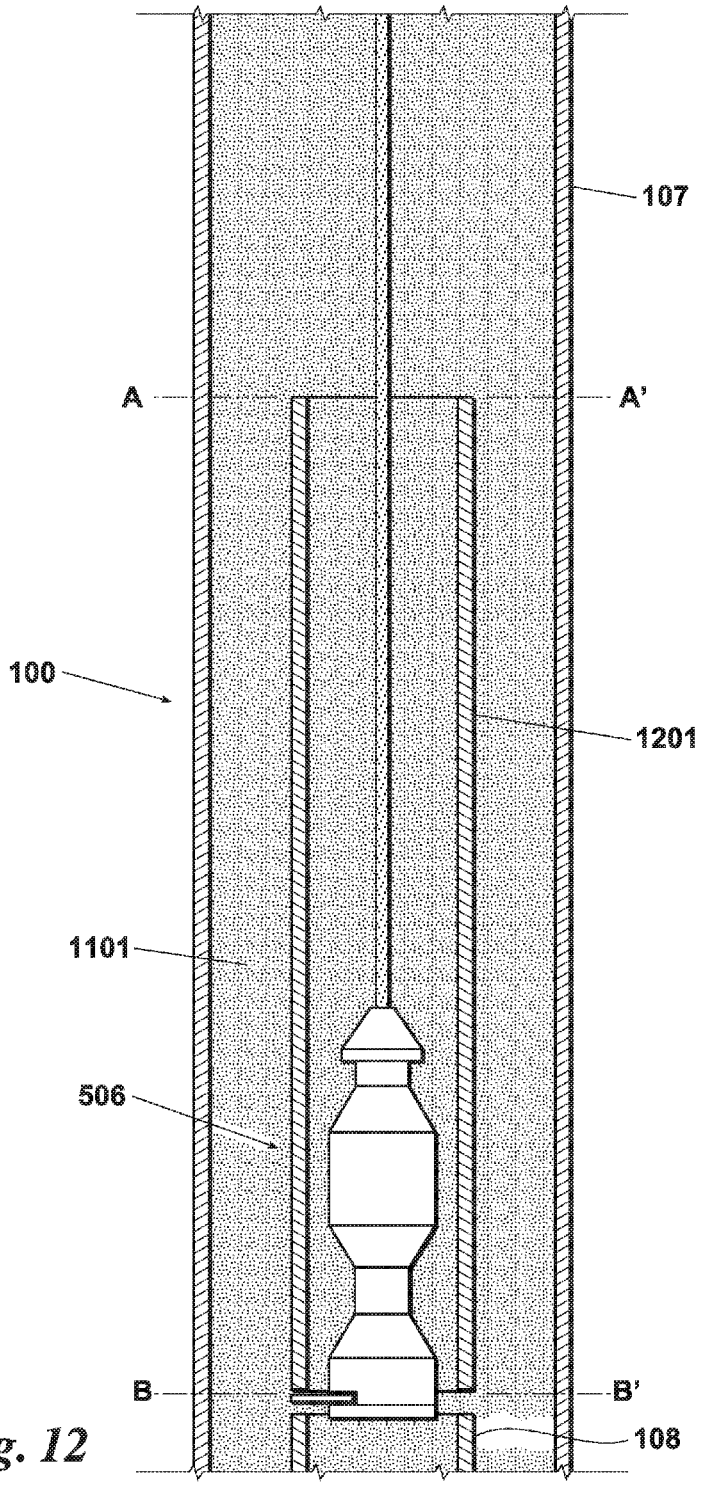
FIG. 12 illustrates the well in FIG. 11, where a cutting tool is used for cutting a lower portion of the tubular.

Now considering FIG. 12; a cutting tool 506 is used to create a new cut B-B' at a location below cut A-A'. By means, an isolated tubing segment 1201 having a first end portion A-A' and a second end portion B-B' has been created. The length of the tubing section 1201 may vary, depending on well conditions as well as operational constraints. However, in a preferred embodiment of the invention, the length of the tubing section 1201 is longer than what is practical to pull using traditional wireline (or alternative) methods, i.e. without using the system of this invention.

The cutting tool 506 may be of a mechanical, pyrotechnical, explosive, chemical or other nature. Such aspects would be appreciated by a person skilled in the art and is no further referred to herein.

Figure 13:
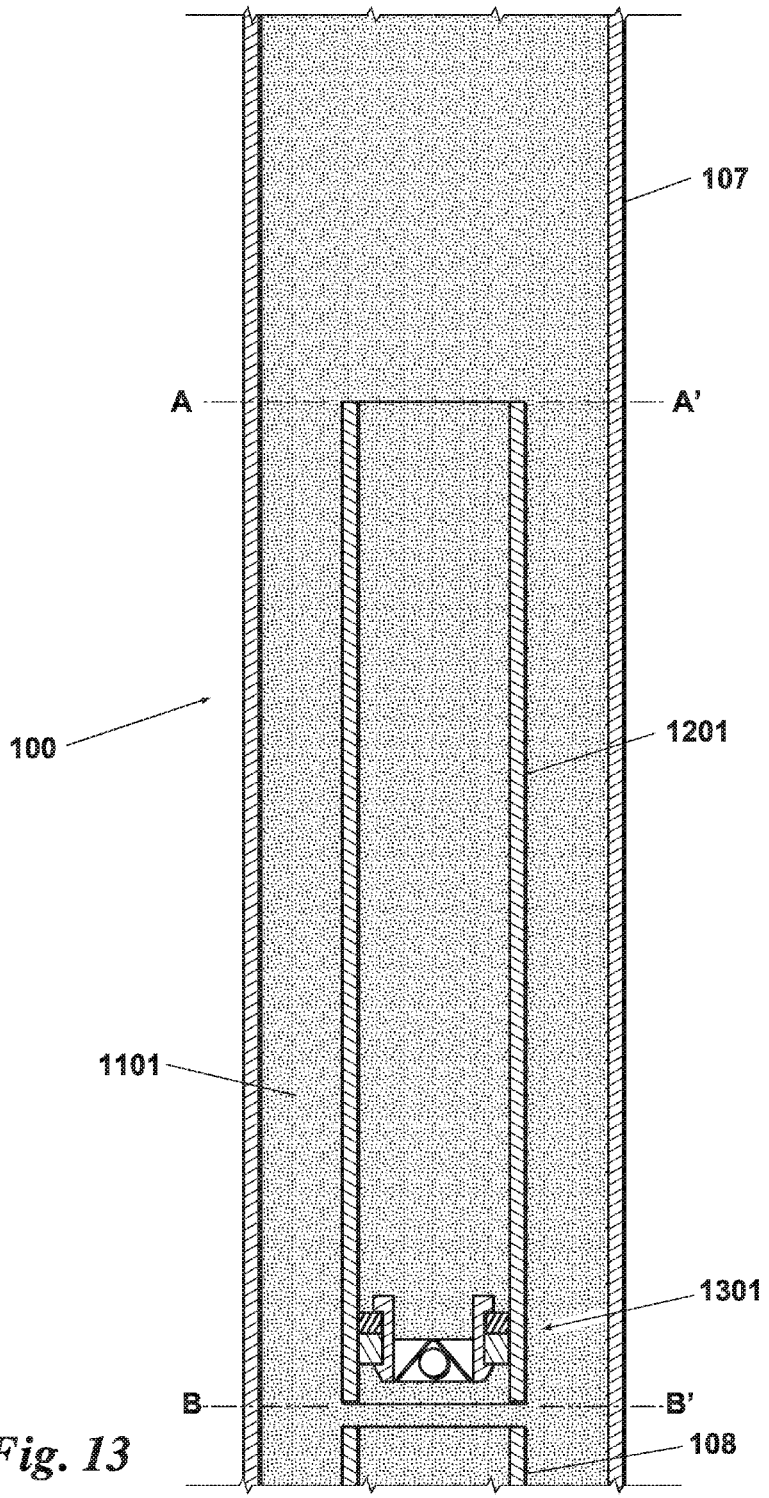
FIG. 13 illustrates the well in FIG. 12, but after the cutting tool has been removed and a barrier has been set in a lower portion of the tubular.

Now considering FIG. 13; here a deep set barrier 1301, such as a mechanical plug comprising a check valve, is installed in a lower portion of the tubing segment 1201. However, in one embodiment of the invention, the barrier 1301 is not required for the tubing 108 pulling operation but is illustrated herein merely to emphasize this operational possibility.

FIG. 14 illustrates a retrieval apparatus according to the present invention in the form of a tubing retrieval module 1401 being engaged to the tubing segment 1201. The tubing retrieval module 1401 comprises a guide nose 1402 for proper entering into the tubing segment 1201, an engagement means in the form of an anchoring module 1403, a sealing means in the form of a seal module 1404 for sealing off a top section of the tubing segment 1201, a control module 1405 and a termination module 1406 where the wireline cable 507 and/or hydraulic line 1407 and/or coil tubing (see FIG. 23) are terminated. In one embodiment (not shown) of the invention, the tubing retrieval module 1401 is split into two or more separate modules that are independently run and operated in the well. Such separate modules may for example be the seal module 1404, the injection means, and retrieval module 1401 with the anchoring module 1403.

In the embodiment shown in FIG. 14, the tubing retrieval module 1401 is engaged in a top portion of the tubing 1201. However, it should be noted that the tubing retrieval module may be engaged anywhere between the first or upper end portion A-A' and the second or lower end portion B-B' of the tubing 1201, as illustrated in FIG. 27.

In FIG. 14 the tubing retrieval module 1401 is run on a combined cable 507 and hydraulic line 1407. However, such a setup may not be desirable due to the risk of the toolstring spinning in the well (hence tangling the cable 507 and hydraulic line 1407 into each other), due to complexity in the surface rig-up, due to difficulties in matching pulling speed and tension between the two line types as well as other factors. In an alternative embodiment, a novel intervention cable is developed and used, that incorporates one or more hydraulic lines inside the cable body. In one associated embodiment, the externals of such a cable resemble cable types that are used for well intervention today. In one embodiment, such a novel cable features a combination of external strands (to provide for mechanical strength) and a hydraulic communication line only. In other embodiments, electric or fiber optic lines may be included in the cable design, to provide for more options with respect to operation of the control module 1405.

In an alternative embodiment, the tubing retrieval module 1401 is run and operated on coil tubing, snubbing pipe or drill pipe. In particular, a coil tubing deployed operation may provide for an attractive operational scenario, as coil tubing may also be used for subsequent cementing operations, hence there is an overlap in equipment requirements in this respect.

The engagement of the anchor 1403 to the tubing segment 1201 may be in the form of a design for automatic engagement, or the engagement may be controlled in form of operator controlled or pre-programmed actions using the control module 1405. Similar considerations apply for the seal module 1404.

FIG. 15 illustrates a key step according to the present invention where a top portion of the tubing segment 1201 is filled with a low density fluid in the form of gas 1501 such as for example, but not limited to, nitrogen or other suitable gases. As mentioned in the general part of the specification; although a low density fluid in the form of a gas 1501 is preferred for increasing the buoyancy of the tubing 1201, the low density fluid may also be a liquid having a lower density than the heavy liquid 1101 to be replaced. Thus, a condensate or even water may be used, for example. However, in the description below the low density fluid will be referred to as gas 1501, but should not exclude other appropriate fluids having a density lower than the heavy liquid 1101 to be replaced.

In the embodiment shown in FIG. 15, the gas 1501 is routed from the surface down the hydraulic line 1407. In a preferred embodiment, the gas 1501 is introduced into the tubing segment 1201 at a pressure that exceeds the hydrostatic pressure in that section of the well 100. This will cause the gas 1501 to displace the heavy liquid 1101 out of the tubing segment 1201 via the check valve of the deep set barrier 1301, as illustrated by the arrows in FIG. 15. For an embodiment where no barrier 1301 is pre-installed, the heavy liquid 1101 will be displaced in an equivalent manner, provided that the tubing segment 1201 is oriented substantially vertically, i.e. with the apparatus 1401 according to the present invention being above the second end portion B-B' of the tubing 1201. For a horizontal alignment, the method would not be suitable unless having a pre-installed barrier 1301 and a check valve system that allowed for bleeding out the fluids prior to letting out the gas. As an example; in a horizontal configuration, the check valve of the barrier 1301 could be designed in an off-center fashion and allowed to freely rotate around the center axis of the barrier 1301. Moreover, the check valve could be provided with or surrounded by a heavy material that would tend to bias the freely rotating check valve towards the lower lying side of the tubing segment 1201 in order to primarily drain out heavy liquid when letting gas 1501 or low density liquids into the tubing segment 1201 as illustrated in FIG. 15.

In one embodiment of the invention, the gas 1501 is routed straight through the control module 1405, i.e. the control module 1405 would in such cases feature an open design. In other embodiments the control module 1405 could be designed to perform more sophisticated tasks such as activating the anchors 1403 and/or the seal 1404 prior to routing high pressure gas 1501 into the tubing segment 1201.

The operation of the control module 1405 could be in the form of an electric or fiber optic operation, or by hydraulic operation such as manipulation of valves set to operate at different pressure. In another embodiment, mechanic counter devices and/or wireless techniques could form part of a control system. In one embodiment of the invention, the operation of the control module 1405 could be in the form of combination of the above methods. In one embodiment, multiple hydraulic lines are deployed into the well as part of the intervention equipment, and the control module 1401 could then be operated in the form of manipulating pressure via such multiple deployed lines. Such aspects of the operation would be appreciated by a person skilled in the art and is no further referred to herein.

Figure 16:
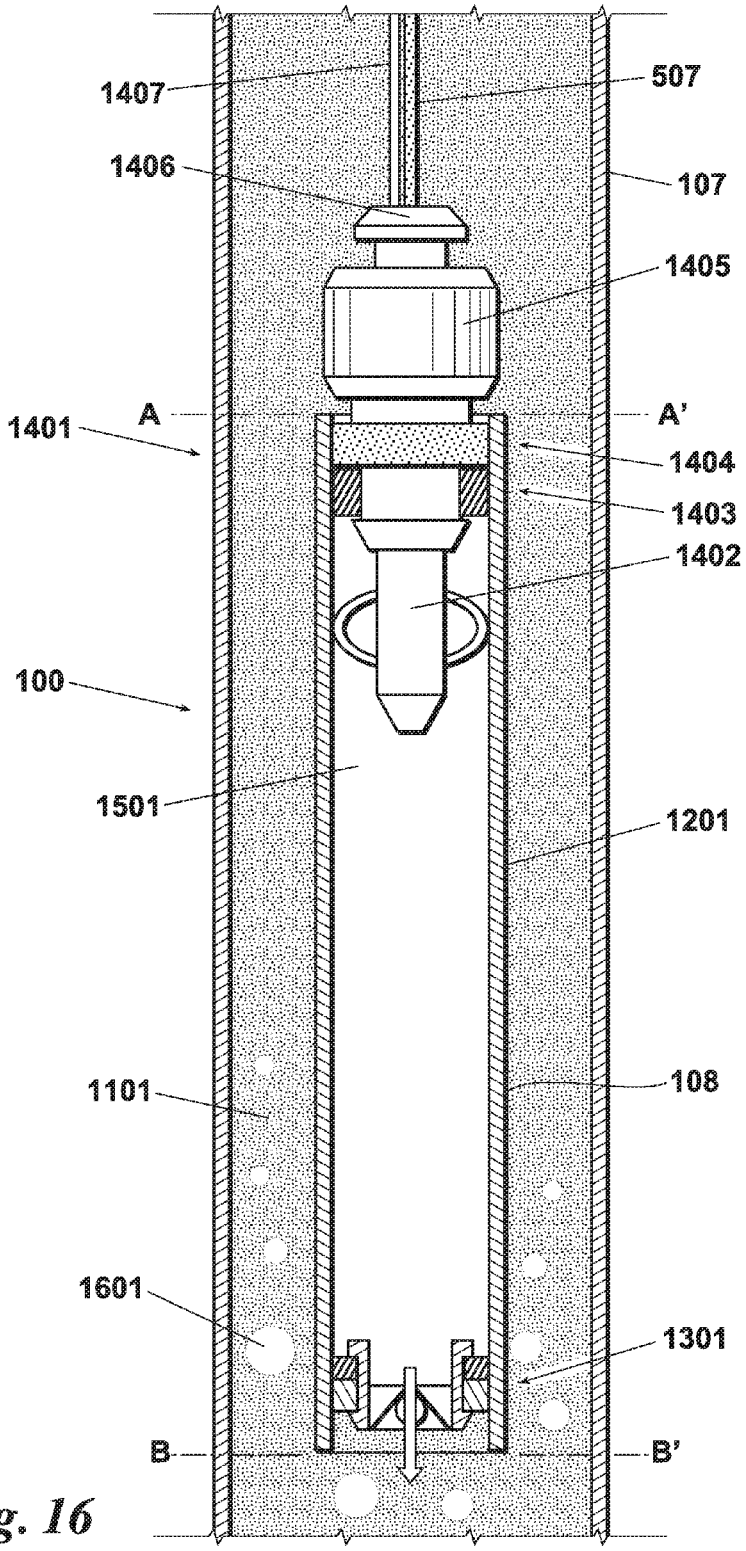
FIG. 16 illustrates retrieval of the tubular filled with gas and the liquid is displaced out of the tubular.

FIG. 16 illustrates retrieval of the tubing segment 1201 from its original position in the well 100. As the tubing segment 1201 is moved upward in the well 100 during retrieval, the surrounding hydrostatic pressure would decrease. This will cause expansion of the gas 1501, and displace the remaining liquid 1101 through the check valve of barrier 1301. This again would entail gas bubbles 1601 trickling through the liquid 1101 towards the top of the well. For such a method a pressure control apparatus would typically be installed on the surface to capture the gas and vent it off in a controllable fashion.

In a preferred embodiment of the invention, as the tubing segment 1201 is retrieved from the well 100 and the surrounding pressure decreases, gas is bled off by means of taking return up the control line 1407, or up the coil tubing 2301 (see FIG. 23) if coil tubing is utilized for the operation. By means, this would eliminate or reduce the amount of free gas that would be released in the liquid 1101. Moreover, this could help limit the buoyancy force that acts on the tubing segment 1201. If the buoyancy force gets sufficiently large, which could be the case if the liquid 1101 is heavy and the pressure of gas 1501 is low, the tubing segment 1201 could float, and this is generally unwanted as it makes the operation of retrieving the tubing segment 1201 less controllable. In one embodiment of the invention, heavier liquids are pumped down the control line 1407 (alternatively the coil tubing 2301) or let into the tubing segment 1201 from the surroundings, during the retrieval operation to reduce the buoyancy force as a function of pulling the tubing segment 1201 out of the well. In another embodiment, as shown in FIG. 27, the retrieval module 1401 including seal module 1404 is installed in a portion of the tubing segment 1201 away from the first end portion A-A' as will be discussed below.

If running the system on coil tubing 2301 (see FIG. 23), there is a general requirement that there should be check valves in the lower portion of the coil tubing (close to the toolstring of relevance). This could prevent the return of gas from the tubing segment 1201 to the surface, and is part of a controlled retrieval operation. In one embodiment of the invention, one or more of the barrier 1301 with check valve built-in, would with respect to functionality replace the need for including check valves in the coil tubing itself.

In a preferred embodiment of the invention the control module 1405 is equipped with sensors (not shown) known per se that help detecting the status such as gas pressure inside and outside the tubing segment 1201, as well as other relevant sensor systems also known per se for monitoring acceleration, motion, velocity and similar, to provide diagnostics data that could form the basis for an intelligent/controlled buoyancy force balancing operation. Temperature effects will also have an impact on the gas density at a given pressure. In one embodiment of the invention, the control module 1405 includes a temperature sensor to monitor and provide for the compensation for such effects. In one embodiment the control module 1405 is equipped with valves for automatically and/or manually bleeding off pressure inside the tubing segment 1201 should this become too high. In particular, when the equipment is located at the top of the well, prior to starting the part of the tubing retrieval process that takes place on the surface, all gas pressure must be bleed out of the system to avoid personnel and/or equipment being exposed to high gas pressure.

In one embodiment the control module 1405 is equipped with valves (not shown) for letting surrounding fluids into the pipe segment 1201. In another embodiment, the control module 1405 is equipped with valves that provides for a controlled routing of liquids from the surface, via the control line 1407 or coil tubing if that is being used for the operation. In one embodiment, such valves are the same valves initially used for routing gas into the tubing segment 1201.

In one embodiment, the control module 1405 can be addressed to activate brake pads or similar to stop unwanted and/or uncontrolled upwards motion of the string due to buoyancy effects. In an associated embodiment, the control module 1405 includes measures for a controlled emergency disconnect function.

Figure 17:
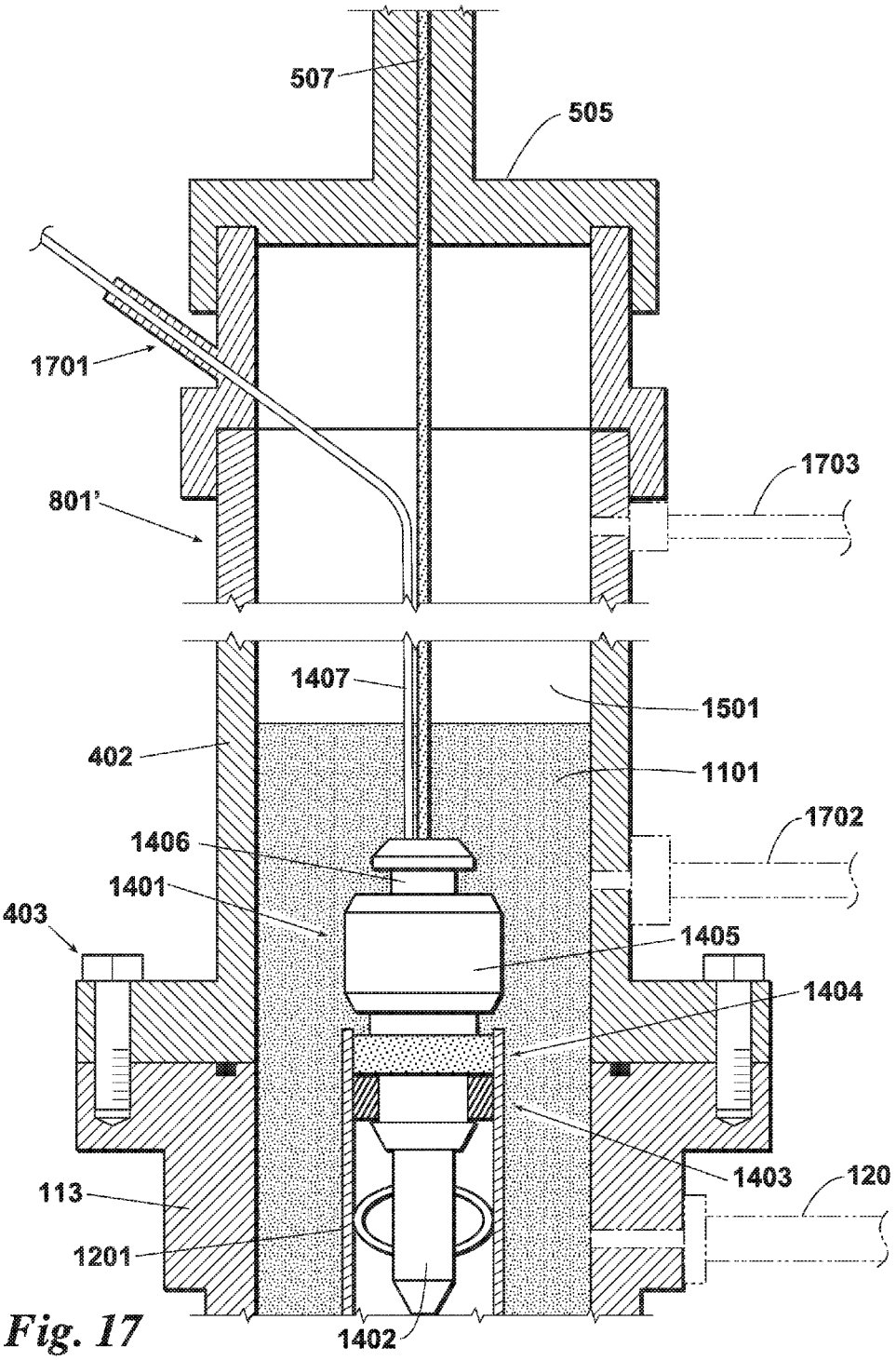
FIG. 17 illustrates in a larger scale parts of a surface pressure control equipment for one embodiment of the invention.

FIG. 17 illustrates parts of the surface pressure control equipment for the embodiment involving a cable 507 combined with a hydraulic line 1407 operation. Here, a control line spool 1701 is added to the pressure control equipment stack to facilitate for running the line 1407. Added features such as BOP equivalent valves may be required. This would be appreciated by a person skilled in the art and no further referred to herein. As explained in relation to FIG. 14; such a setup may not be desirable. In the future, wireline cables that incorporate a hydraulic line may be made for such purposes. In the short term, the deployment and operation of the tubing retrieval system on coil tubing may prove to be equivalently or more attractive than the scenario illustrated in FIG. 14 where a cable 507 and a hydraulic line 1407 is run side-by-side.

FIG. 17 also illustrates a fluid line 1702 used to fill additional fluid into the well 100 as the tubing section 1201 is retrieved, and to kill the well in the case of emergency. In real life operations, additional lines may be used to create a circulation envelope. This would be appreciated by a person skilled in the art. Moreover, a pressure control stack may include one or more bleed-off line(s) 1703 used to bleed off gas 1501 pressure should free gas 1501 be released to the well fluid 1101 during the operation.

Figure 18:
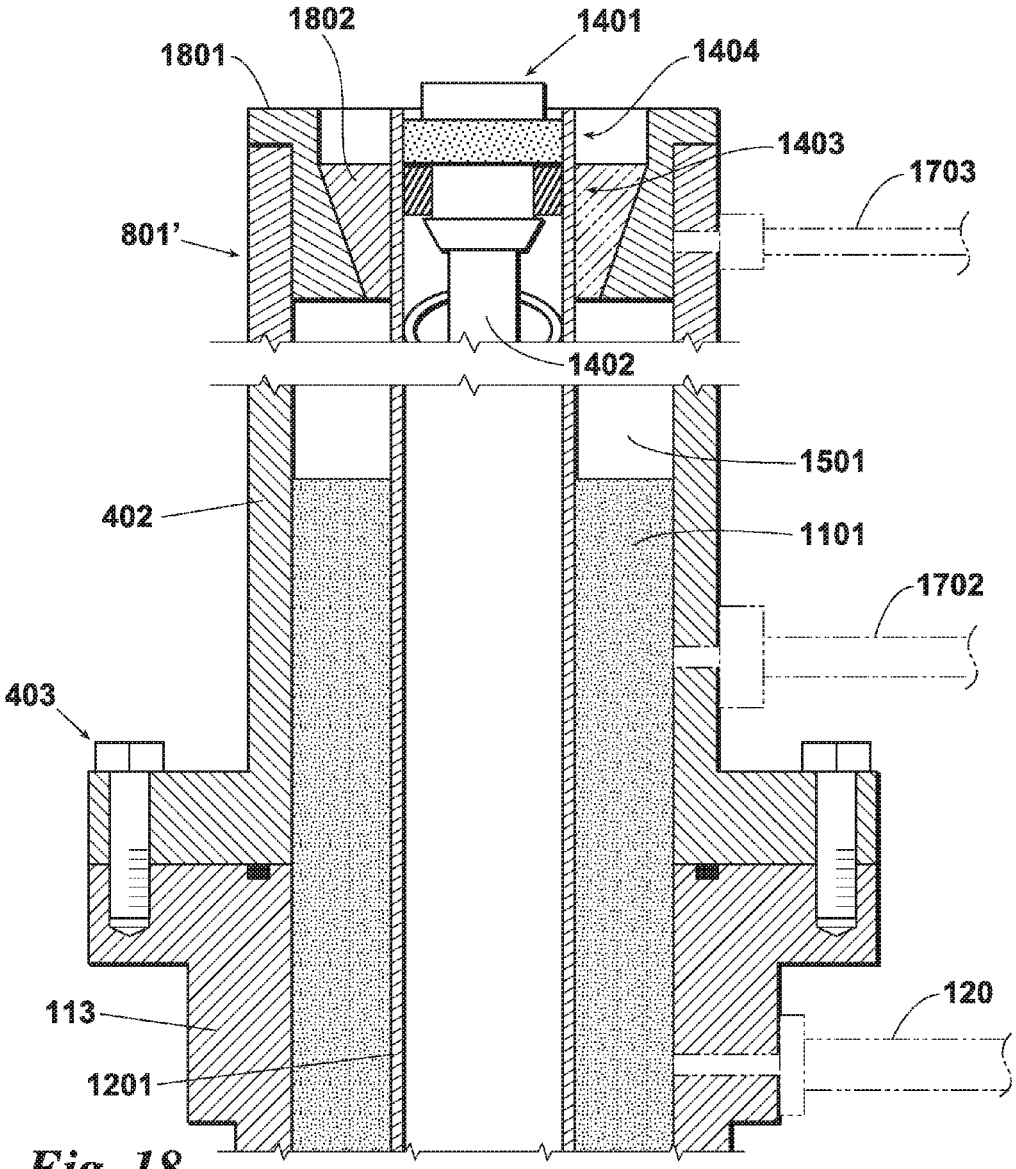
FIG. 18 illustrates a step of physical disassembly and removal of the tubing when this has reached the surface.

FIG. 18 illustrates a first step of physical disassembly and removal of the tubing segment 1201 when this has reached the surface. In FIG. 18, the control line spool 1701 and the grease injection head 505 has been taken off the pressure control stack, and a bushing 1801 to facilitate the alternating use of pipe slips 1802 has been mounted. Further details related to systems and methods for mounting and operating these modules would be appreciated by a person skilled in the art and is not described herein.

For the embodiment illustrated in FIG. 18, the control module 1405 and a termination module 1406 of the tubing retrieval tool 1401 has been removed, and the tubing segment 1201 is hung off in slips 1802. Subsequent to this, the anchoring module 1403, the seal module 1404 and the guide nose 1402 is removed.

Figure 19:
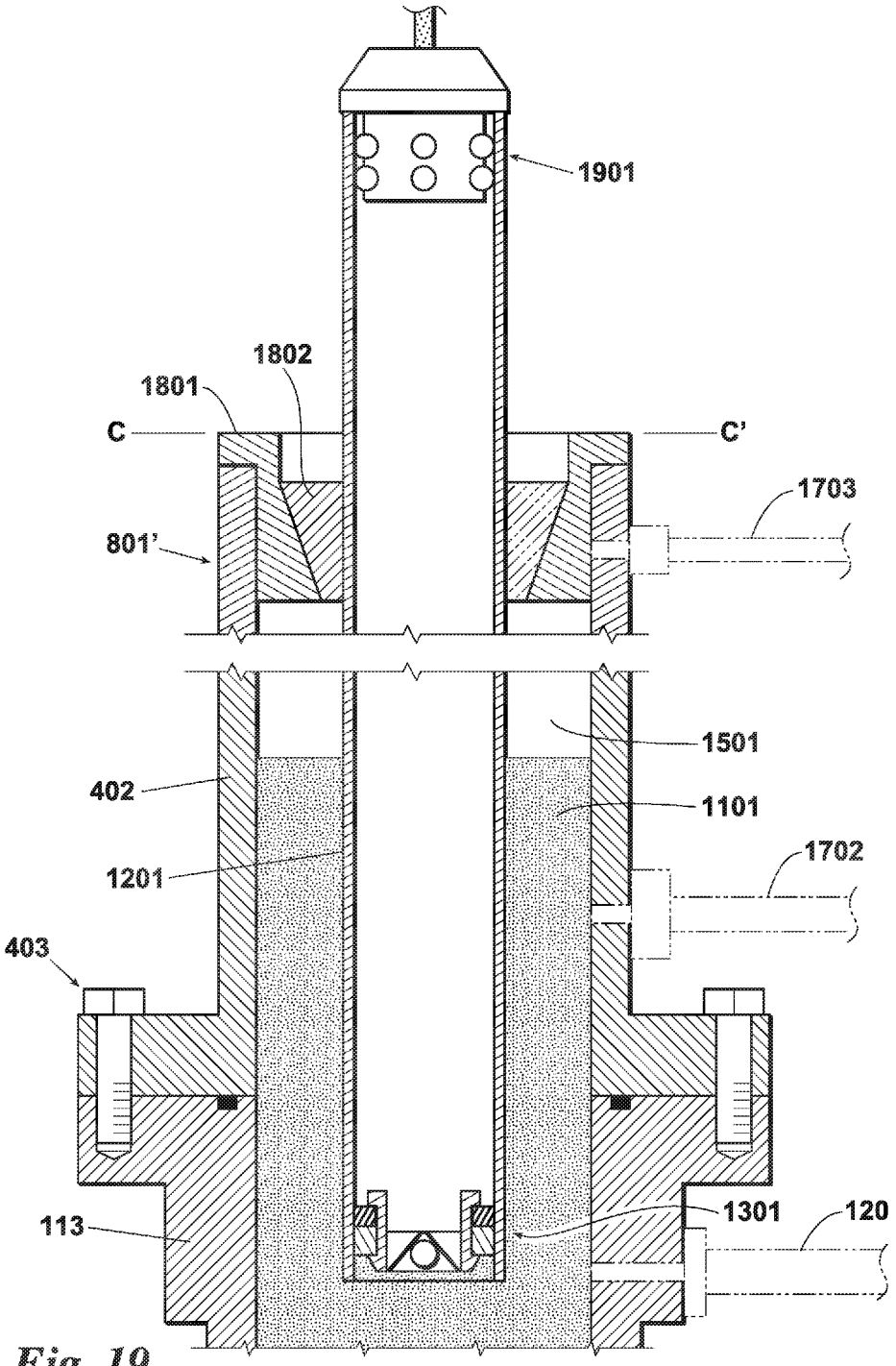
FIG. 19 illustrates a lifting device lifting the tubing out of the well.

FIG. 19 illustrates a lifting device such as a ball grab 1901 being connected to the top of the tubing segment 1201 and lifting this out of the well 100. For this lifting operation, the wireline mast 901 of FIG. 9 or the traverse-crane 1002 of FIG. 10 could be utilized.

Subsequently, the tubing segment 1201 is cut at an appropriate distance from the top, illustrated by the line C-C', whereupon the cut tubing piece is removed and laid down on a deck of the rig. For this purpose, a pipe handling mast 1003 as illustrated in FIG. 10 could be used. Various techniques could be used to create the cut C-C', including but not limited to abrasive water cutters, wire cutters and blade cutters. This would be appreciated by a person skilled in the art.

The process is then repeated until the entire tubing segment 1201 has been retrieved hence removed from the well.

Figure 20:
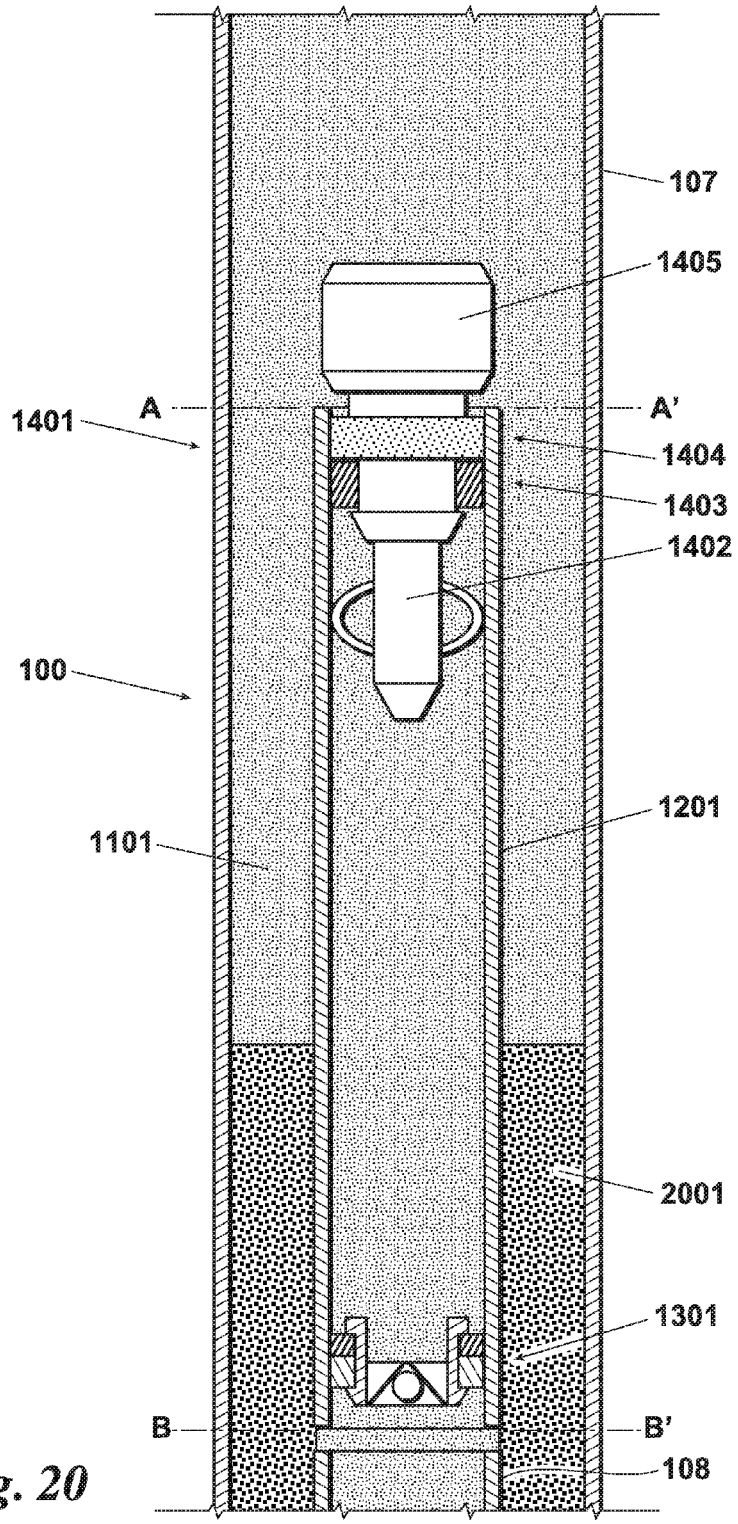
FIG. 20 illustrates a situation where the tubing is stuck in the well.

FIG. 20 illustrates a situation where settled material 2001 such as for example barite, or other conditions have made the tubing segment 1201 stuck in the well. In FIG. 20, the tubing retrieval tool 1401 has been disconnected above the control module 1405. In a preferred embodiment of the invention, it is possible to perform controlled system disconnects. Moreover, in a preferred embodiment of the invention, a disconnect operation would leave a fresh engagement profile and seal surfaces inside or outside the top module that is left in the well for re-engagement and continuation of the operation at a later stage with heavier equipment such as coil tubing, snubbing pipe or drill pipe.

Figure 21:
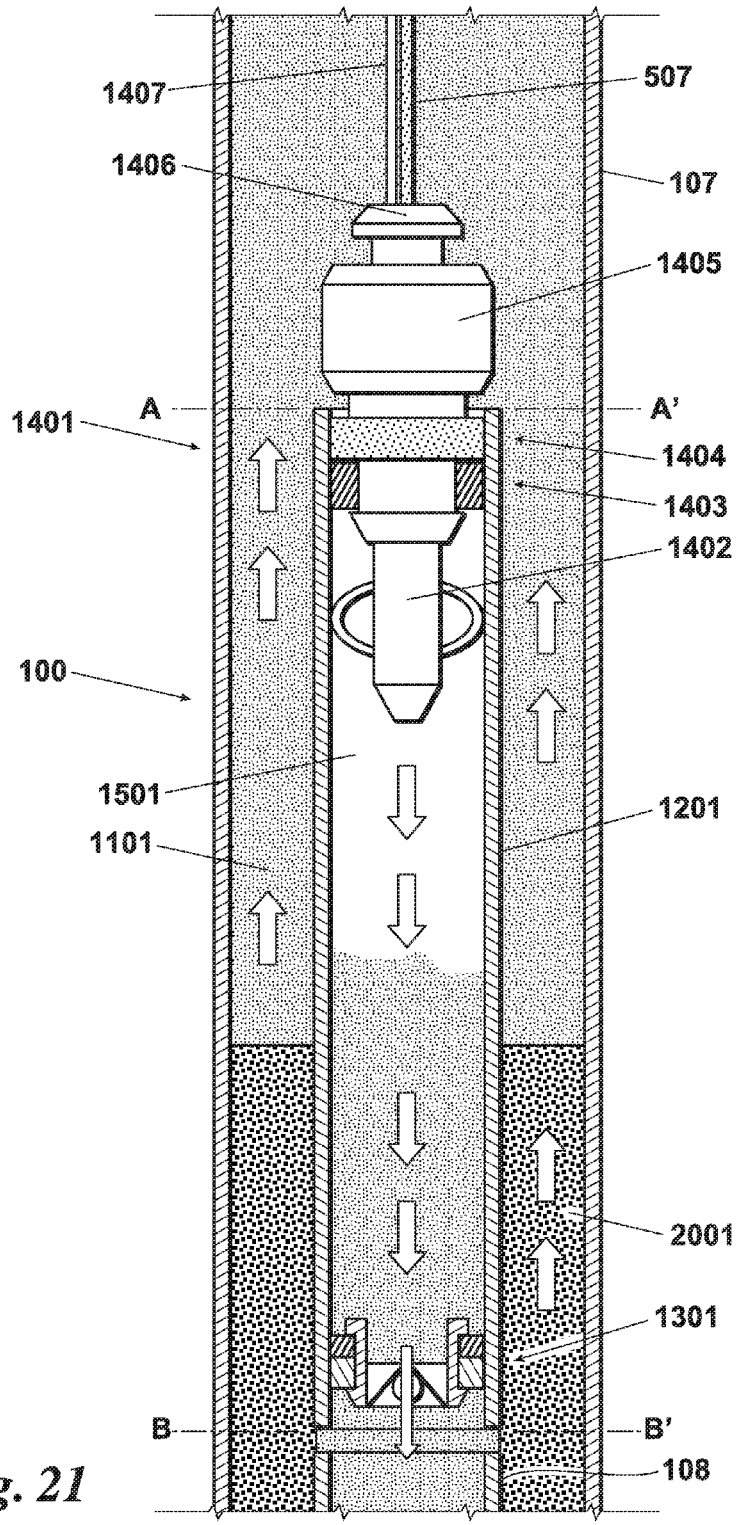
FIG. 21 illustrates a step where the apparatus according to the present invention is used for releasing the stuck tubing.

FIG. 21 illustrates a method for releasing a stuck tubing segment 1201 further to the case illustrated in FIG. 20, where high pressure gas or liquid is routed into the tubing segment 1201 as per previously described procedure(s). The aim is to create fluid circulation through the column of settled barite 2001 or similar, so that this will soften and/or erode or flow away, and thereby release the tubing segment 1201. Thus the apparatus 1401 according to the present invention is utilized for releasing a stuck tubing segment 1201. Alternatively a downhole jack system as described in the general part of this document could be used to operate/work the tubing segment 1201 loose prior to pulling it out of the hole using techniques as defined by the invention herein. Similar means could be applied to tear off uncut control lines, or to overcome forces required to split the tubing should the process to make the cut B-B' be only partly successful.

Figure 22:
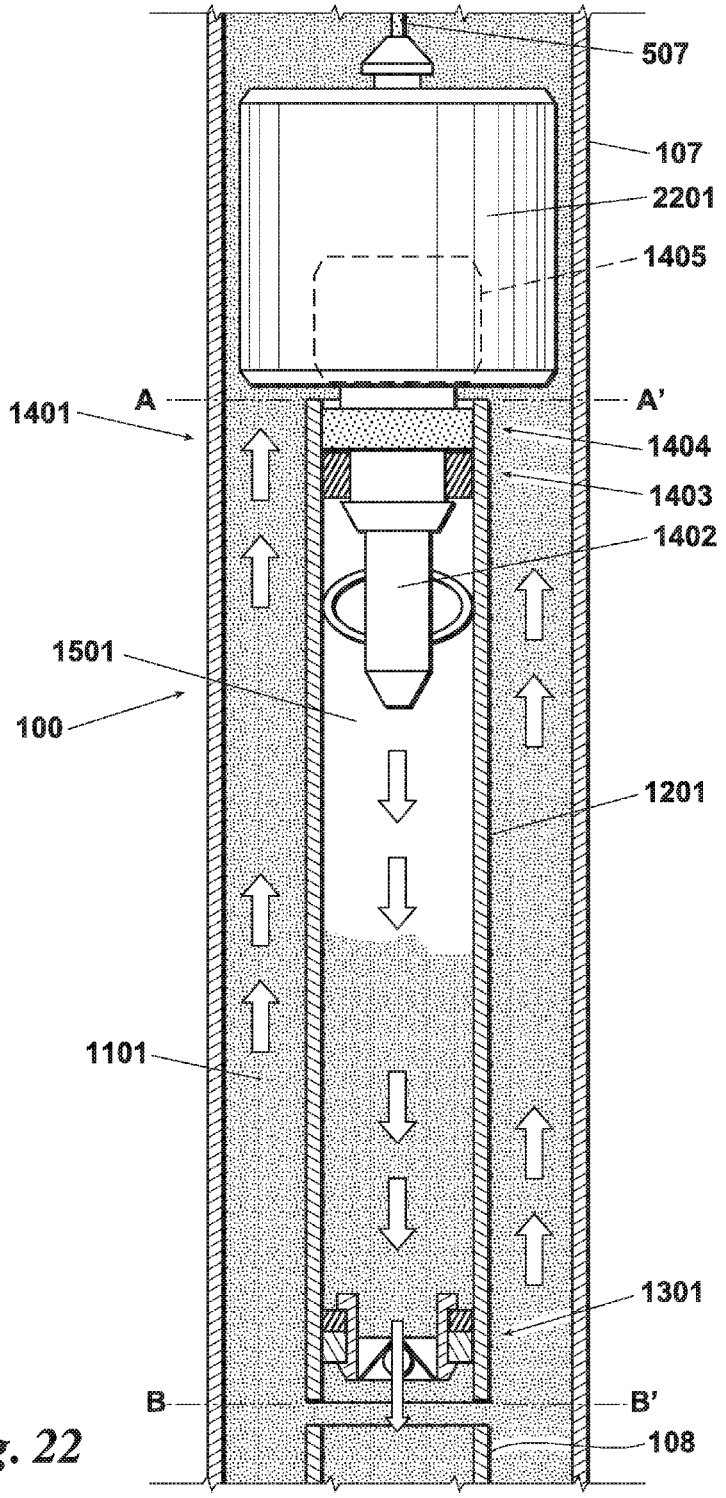
FIG. 22 illustrates the same as FIG. 15 with an alternative embodiment of the apparatus according to the present invention.

In one embodiment of the present invention, high pressurized gas for filling at least parts of the tubing segment 1201 is deployed into the well as part of the wireline toolstring. In the embodiment shown in FIG. 22, the gas is contained in a high pressure flask 2201 or similar deployed into the well 100. Do note that in this case the hydraulic control 1407 line to surface can be omitted, and the operation conducted on wireline 507 only.

Figure 23:
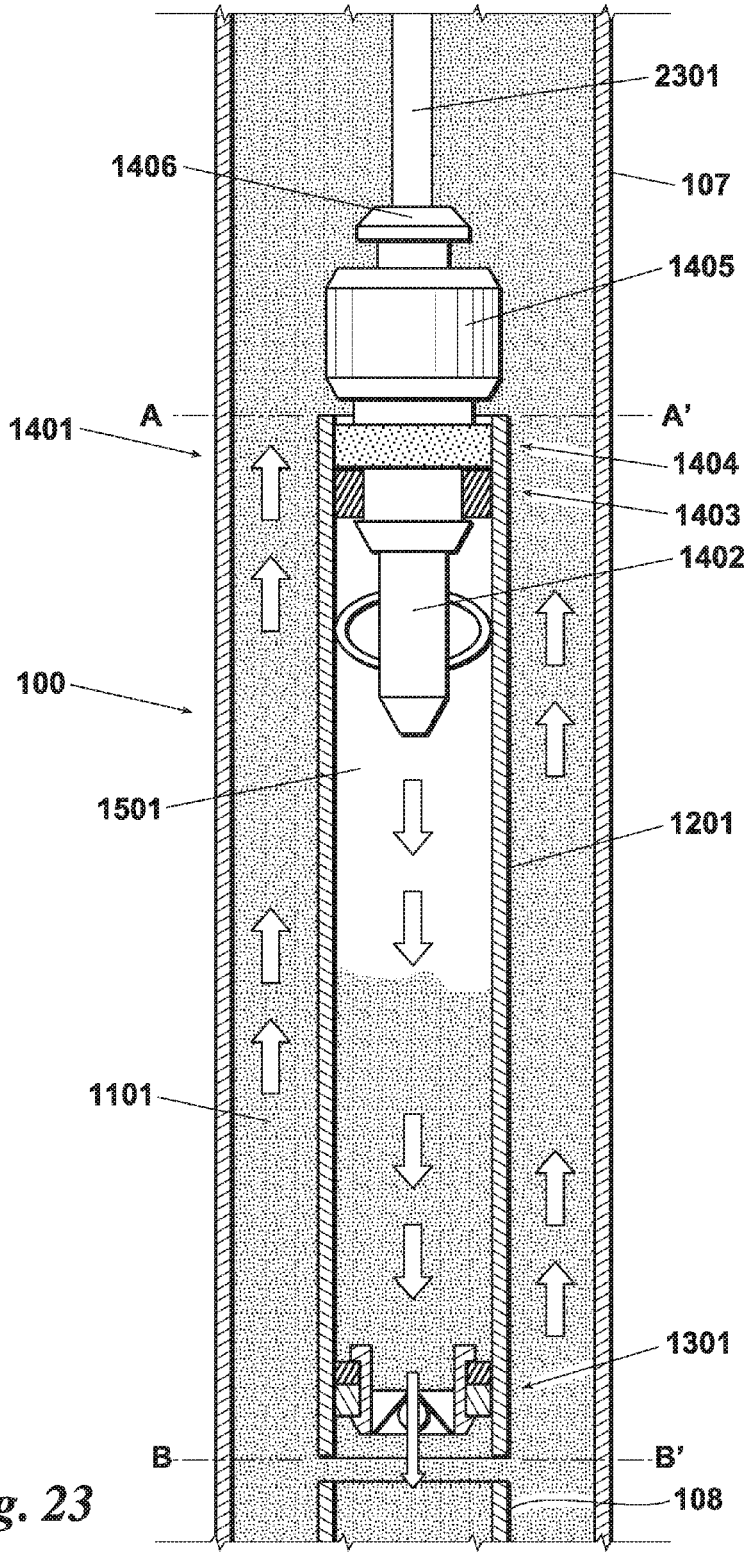
FIG. 23 illustrates the same as FIG. 15 in an alternative embodiment where the apparatus is connected to a coil tubing.

In another embodiment of the invention (not shown), the gas is created locally by burning a similar type of power charges that are used in setting tools for downhole plug setting, mix certain chemicals, or expose certain chemicals to certain solids, as will be appreciated by a person skilled in the art FIG. 23 illustrates the operation conducted on coil tubing 2301. A benefit here is that coil tubing is capable of applying higher operative force (pull/push) than wireline 507, and that the need for a dual line operation such as the combined wireline 507 and hydraulic line 1407 illustrated in the previous figures, is removed.

FIG. 24 illustrates the operation conducted on a special wireline 2401 containing a hydraulic line inside it. FIG. 25*a* and FIG. 25*b* illustrate cross sectional views for two versions of such special wireline 2401. FIG. 25*a* illustrates a hydraulic centre pipe 2501, covered by a bonding layer 2502 and an outer layer of wire strands 2503. The bonding layer 2502 could be included to create necessary friction between the centre pipe 2501 and the strands 2503. In other embodiments, there could be multiple strand 2503 layers, or the strands 2503 could be embedded into an outer layer 2504 made of polymer or similar to provide for a slick purpose and remove the need for a grease injection head (i.e. this could be replaced with a simpler design packer based seal). An example of such is illustrated in FIG. 25*b*. FIG. 25*b* also illustrates an electric lead 2505 embedded in the cable. In general, all known methods for cable manufacturing that includes one or more hydraulic conduits within the framework of the cable could be utilized for such purposes. This will be appreciated by a person skilled in the art.

With reference to FIG. 26; in one embodiment of the invention, a smaller portion of high pressurized gas is placed in the top section of the tubing segment 1201 (by any means described herein), whereupon a pump (not shown) inside the tubing retrieval tool 1401 is used to pump fluid out of the isolated tubing segment 1201 between the barrier 1301 and the tubing retrieval tool 1401 via a straw system 2601 and into the surroundings. In the embodiment illustrated in FIG. 26, a defined portion of gas 1501 is let into the tubing segment 1201 via gas injection means exiting via gas nozzles 2602. Subsequent to this, a pump (not illustrated) located somewhere in the wireline toolstring is used to suck/pump liquid out of the bottom portion of the tubing segment 1201 via an inlet 2603 of the straw 2601. The fluids flows from said inlet via internal conduits of the straw 2601 to a liquid outlet 2604 located outside the tubing segment 1201. By means, as liquid is removed from the tubing segment 1201, the pressure decreases, whereupon the gas 1501 portion increases in size and—ultimately—the buoyancy force acting on the tubing segment 1201 increases.

The benefit of the apparatus illustrated in FIG. 26 is that it provides for a possibility to fill a substantial part of the tubing segment 1201 with gas despite only being able to deploy a relatively low/modest amount of high pressure gas into the well as part of the tool string. Moreover, such an operation would entail the placement of a relatively large gas portion inside tubing segment 1201 that is of a lower pressure than the surrounding pressure; hence the density of the gas would be less than would be the case if the gas was to be pressurized to equal the surroundings. In the case of placing a low pressure gas column inside the tubing section 1201, the buoyancy force would be higher than for the equal pressure case, which could be beneficial for the operation.

In FIG. 27 the retrieval module 1401 including seal module 1404 is not installed in a top portion of the tubing segment 1201 as illustrated for example in FIG. 14, but at a location further down the tubing segment 1201, as mentioned above. The intention with such an arrangement is to avoid filling the entire tubing segment 1201 substantially defined by the first end portion A-A' and the second end portion B-B' with gas 1501 as illustrated in FIG. 16, hence risk the tubing segment 1201 being exposed to a net upwards force due to buoyancy during certain stages of the retrieval process. By means, for this method only a portion of the tubing segment 1201 can be filled with gas.

In FIG. 27 a gas injections means in the form of a gas injection manifold 2702 is also illustrated. Such a gas injection manifold 2702 may also be provided in the apparatus shown in for example FIGS. 14-16. Gas 1501 (see FIG. 15) supplied from the surface via the line 1407 flows via the gas injection manifold 2702 and out of the guide nose 1402 as illustrated by the dotted line 2701.

In FIG. 28 the apparatus is provided with an inflatable bladder 2801 that replaces the liquid 1101 in the tubing 1201 as gas 1501 is injected into the bladder 2801 by means of the gas injection means. In the embodiment shown the bladder 2801 is arranged at an end portion of the guide nose 1402 and separate from the seal module 1404. However, as the bladder 2801 itself provides a sealing means, the seal module 1404 may be omitted. The bladder 2801 will keep the gas separate from the liquid 1101. In the embodiment shown in FIG. 28 the bladder 2801 is arranged at an elevation lower than the anchor module 1403. However, the bladder 2801 may in an alternative embodiment (not shown) be arranged at an elevation above the anchor module 1403.

In a preferred embodiment, the method and the apparatus according to the present invention is used to retrieve tubular 1201 from a subsea well 100 using a light weight intervention vessel (RLWI vessel). Further to a preferred embodiment, tubing 1201 from a subsea well 100 is retrieved to the surface in lengths that equals the sea depth above the wellhead, minus operational margins as defined by the vessel and the pressure control equipment plus safety margins. Moreover, further to the same embodiment, rather than pulling the tubing 1201 to the vessel, the tubing 1201 is transferred to a secondary vessel dedicated for disposal of the tubing. In one embodiment, the transfer system yields making a connection to the top portion of the tubing with a wire or similar run from the secondary vessel prior to performing a controlled disconnect from the cut tubing from the wire suspended from the intervention vessel. By means, the process of pulling tubing from subsea wells can now be optimized, using wireline intervention vessels for the downhole operations, but secondary vessels for the pipe handling. This way, sophisticated intervention vessels do not need upgrading for pipe handling, which would be a very costly exercise. The secondary vessel could in one embodiment disassemble the cut tubing pieces locally. In another embodiment, the secondary vessel would tow the cut tubing segments to a location closer to land, where purpose built handling systems could perform the final breakdown operations on the tubing in a more cost effective manner.

While the invention has been described with a certain degree of particularity, many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A method for retrieving a tubing (1201) from a well (100) at least partly filled with a liquid (1101), the tubing (1201) having a first end portion (A-A') and a second end portion (B-B'), said method comprising the steps of:

running a retrieval apparatus (1401) using a connecting means (507, 2301, 2401) from a surface and into the well (100), the retrieval apparatus (1401) comprising:

an engagement means (1401) for engaging the tubing (1201);

a sealing means (1404) for sealing a portion of the bore of the tubing (1201);

injection means for injecting a low density fluid into the tubing (1201), connecting the engagement means (1401) to a portion of the tubing (1201);

activating the sealing means (1404) to close liquid communication in the bore of the tubing (1201) between the first end portion (A-A') and the second end portion (B-B');

replacing at least a portion of a volume of liquid (1101) by a low density fluid (1501) introduced in said volume by the injection means; and retrieving the tubing (1201) out of the well (100) using the connecting means (507, 2301, 2401).

2. The method according to claim 1, wherein the volume of liquid (1101) is defined by the sealing means (1404), the tubing (1201) and the second end portion (B-B') of the tubing (1201).

3. The method according to claim 1, wherein the sealing means (1401) comprises an inflatable bladder arranged to be filled with the low density fluid (1501) so that the low density fluid replaces the volume of liquid (1101) by increasing the volume of the bladder.

4. The method according to claim 1, wherein the low density fluid (1501) is supplied from the surface of the well through a line (1407) extending from the surface to the apparatus (1401).

5. The method according to claim 1, wherein the low density fluid (1501) is supplied from a vessel (2201) operable to communicate low density fluid to the injection means, the vessel (2201) being arranged between the apparatus (1401) and the surface of the well (100).

6. The method according to claim 4, wherein the low density fluid (1501) is supplied from both the surface of the well (100) and from a vessel (2201).

7. The method according to claim 1, further comprising controlling buoyancy of the tubing (1201) during retrieval by replacing a volume of the low density fluid (1501) in the tubing (1201) by a liquid.

8. The method according to claim 1, further comprising introducing a packer 1301 in the bore of the tubing (1201) between the sealing means (1404) and the second end portion (B-B') of the tubing (1201).

9. An apparatus (1401) for retrieving an open ended tubing segment (1201) from a well (100) at least partly filled with a liquid (1101), the tubing segment (1201) having a first end portion (A-A') and a second end portion (B-B'), said apparatus (1401) comprising:

a connection means extending from a surface of the well to provide a connection between a portion of the apparatus and said surface of the well;

an engagement means (1403) for engaging the tubing segment (1201);

a sealing means (1404) arranged between the first end portion and the second end portion to prevent the liquid from flowing through the tubing segment (1201); and injection means for injecting a low density fluid (1501) into the tubing segment (1201) in or at an elevation below; the sealing means (1404), the low density fluid (1501) having a density being lower than the density of said liquid so that liquid within the tubing segment is urged out of the tubing segment below the sealing means to increase the buoyancy of the tubing segment.

10. The apparatus (1401) according to claim 9, further comprising a control module (1405) having means selected from one or more members from the group consisting of: means for controlling the engagement means; means for controlling the sealing means; one or more sensor means selected from of the group consisting of: pressure sensor, temperature sensor, acceleration sensor, or velocity sensor.

11. The apparatus according to claim 10, wherein the control module (1405) is further provided with at least one valve for communicating a fluid into or out of the tubing (1201).

12. The apparatus according to claim 10, wherein the control module (1405) further comprising means for disconnecting the connecting means (507, 2301, 2401) from the apparatus (1401).

13. The apparatus according to claim 9, wherein the apparatus (1401) is further provided with a pumping device (2603, 1402, 2604) arranged for evacuating a liquid contained between the sealing means (1404) and a packer (1301) arranged in the bore of the tubing (1201) between the sealing means (1404) and the second end portion (B-B') of the tubing (1201).

* * * * *